US011254464B2

(12) United States Patent
Chen

(10) Patent No.: US 11,254,464 B2
(45) Date of Patent: Feb. 22, 2022

(54) PACKAGE SYSTEM

(71) Applicant: APVLAB LLC, Diamond Bar, CA (US)

(72) Inventor: Kevin Chen, Diamond Bar, CA (US)

(73) Assignee: APVLAB, LLC, Chino, CA (US)

( * ) Notice: Subject to any disclaimer, the term of this patent is extended or adjusted under 35 U.S.C. 154(b) by 0 days.

(21) Appl. No.: 16/809,544

(22) Filed: Mar. 4, 2020

(65) Prior Publication Data

US 2021/0276758 A1 Sep. 9, 2021

(51) Int. Cl.

| | |
|---|---|
| ***B65D 5/38*** | (2006.01) |
| ***B65D 5/50*** | (2006.01) |
| ***B65D 5/42*** | (2006.01) |
| ***B31B 50/20*** | (2017.01) |
| ***B31B 50/26*** | (2017.01) |
| *B31B 110/35* | (2017.01) |
| *B31B 120/30* | (2017.01) |
| *B31B 120/60* | (2017.01) |

(52) U.S. Cl.

CPC ..... *B65D 5/38* (2013.01); *B31B 50/20* (2017.08); *B31B 50/26* (2017.08); *B65D 5/4266* (2013.01); *B65D 5/503* (2013.01); *B31B 2110/35* (2017.08); *B31B 2120/302* (2017.08); *B31B 2120/60* (2017.08); *B65D 2215/00* (2013.01); *B65D 2401/10* (2020.05)

(58) Field of Classification Search

CPC ..... B65D 5/38; B65D 5/4266; B65D 5/503; B65D 2215/02; B65D 2215/04; B65D 2215/00; B65D 11/12; B65D 2575/362

USPC ..... 229/102, 125.125, 122, 220; 206/532, 206/538, 807, 250, 531; 220/281

See application file for complete search history.

(56) References Cited

U.S. PATENT DOCUMENTS

| | | | | |
|---|---|---|---|---|
| 4,364,488 | A * | 12/1982 | Anjou | A24F 27/00 220/281 |
| 6,491,211 | B1 * | 12/2002 | Evans | B65D 5/38 206/532 |
| 7,708,142 | B2 * | 5/2010 | Ehrlund | B65D 5/38 206/528 |
| 7,757,843 | B2 * | 7/2010 | Katsis | A24F 27/00 206/1.5 |
| 9,815,584 | B2 * | 11/2017 | Schwester | B65D 43/161 |
| 10,167,109 | B2 * | 1/2019 | Warner | A61J 1/03 |
| 2019/0084740 | A1 * | 3/2019 | Davis | B65D 75/367 |

* cited by examiner

*Primary Examiner* — Christopher R Demeree

(74) *Attorney, Agent, or Firm* — Loza & Loza, LLP; Heidi Eisenhut

(57) ABSTRACT

A package system is provided. The package system comprises a carton having at least a first carton panel including a first tab having a first tab edge defined by internal walls of the first panel, a second carton panel opposing the first panel, and a third carton panel between the first carton panel and the second carton panel, the carton having a carton length that is defined as a first distance parallel to the third carton panel between the first carton panel and the second carton panel; and a drawer configured to slide into and out of an interior of the carton, the drawer having at least a first drawer panel opposing the first carton panel, a second drawer panel opposing the second carton panel, and a third drawer panel opposing the third carton panel, the third drawer panel adjoined between the first drawer panel and the second drawer panel.

15 Claims, 10 Drawing Sheets

DIE CUTTING LINE
INDENTATION (FOLD-LINE)
PERFORATED LINE

PACKAGE SYSTEM

BACKGROUND

Field

The present disclosure relates to the field of packaging. More specifically, the present disclosure relates package systems having outer cartons and inner drawers that may each be formed, or may together be formed, from a single sheet of material (e.g., a one piece blank). Still more specifically, the present disclosure relates to package systems having tamper-evident, tamper-resistant, or tamper-evident, tamper-resistant, or tamper-evident and tamper-resistant features that may be formed from a single sheet of material (a one piece blank).

Background

Packaging systems may be used to contain products such as medicines, flavor pods for e-cigarettes, or toxic substances. The products may be physically harmful to children or simply not desirable to allow into the hands of children. Packaging systems may include tampering-evident features, which may provide some evidence of tampering with the contents of a package, or at least may provide some evidence that a person has accessed, or tried to access, the contents of a package. One example of a tamper-evident feature may be a foil-backed pill package, where the foil must be ripped open to gain access to a pill. The ripped foil would provide evidence of tampering with the contents of a package, or at least may provide evidence that a person has accessed, or tried to access, the contents of the package. Packaging systems may include tampering-resistant features, which may offer some resistance to accessing the contents of a package. One example of a tamper-resistant feature may be a plastic shrink-wrap, such as transparent plastic shrink-wrap, where the shrink-wrap would need to be breached in order to tamper with the contents of the package.

Children are naturally curious and may even enjoy trying to open a package. Tamper-evident and/or tamper-resistant features, like, for example, the just-mentioned package foil covering and/or package shrink-wrap may be breached by a child. What is needed is a package system that uses the child's size (as compared to an adult's size) to the advantage of packaging system safety.

SUMMARY

According to one aspect, a package system is provided. The package system comprises a carton having at least a first carton panel including a first tab having a first tab edge defined by internal walls of the first carton panel, a second carton panel opposing the first carton panel, and a third carton panel adjoined between the first carton panel and the second carton panel, the carton having a carton length ($L_C$) that is defined as a first distance parallel to the third carton panel between the first carton panel and the second carton panel; and a drawer configured to slide into and out of an interior of the carton, the drawer having at least a first drawer panel opposing the first carton panel, a second drawer panel opposing the second carton panel, and a third drawer panel opposing the third carton panel, the third drawer panel adjoined between the first drawer panel and the second drawer panel, the drawer having a drawer length ($L_D$) that is defined as a second distance parallel to the third drawer panel between the first drawer panel and the second drawer panel.

According to one feature, the second drawer panel remains within the carton when the first drawer panel is spaced apart from the first carton panel by a safety length ($L_S$) that is defined as a maximum length of an object that, upon insertion of the object into the carton past the first tab edge of the first carton panel, causes the second drawer panel to be situated within the interior of the carton and juxtaposed with a plane defined by a mouth of the carton that is proximal to the second carton panel.

According to another feature, the carton includes a first plurality of panels including the first carton panel, the second carton panel, and the third carton panel, and the first plurality of panels encloses and defines the interior of the carton.

According to yet another feature, the first tab edge is a first row of perforations and the first tab is defined by the first tab edge and a first tab fold-line that bridges spaced apart ends of the first row of perforations.

According to yet another feature, the safety length ($L_S$) is an average length of a middle finger of a child.

According to yet another feature, the drawer is configured to slide into and out of the interior of the carton along an axis parallel to the third carton panel.

According to yet another feature, the first tab is configured to provide evidence of insertion of the object into the carton past the first tab edge of the first carton panel.

According to yet another feature, the packaging system further comprises a second tab included with the third carton panel and having a second tab edge defined by internal walls of the third carton panel and a second tab fold-line, the second tab folding toward an interior of the carton along the second tab fold-line.

According to yet another feature, the second tab edge is demarcated by at least one of a cut-line or a second row of perforations.

According to yet another feature, the second tab is configured to be situated between the third carton panel and the third drawer panel when the third drawer panel is adjacent to the second tab fold-line.

According to yet another feature, wherein a sliding motion of the drawer past the second tab fold-line from a first end of the carton that is proximal to the first carton panel toward a second end of the carton that is distal to the first carton panel is resisted by the second tab.

According to yet another feature, wherein the second tab resists the sliding motion of the drawer by having: a first orientation that is substantially parallel the second drawer panel when the second drawer panel is adjacent to the second tab fold-line, and a subsequent second orientation that is parallel to and between the third carton panel and the third drawer panel when the third drawer panel is adjacent to the second tab fold-line.

According to yet another feature, the second tab resists the sliding motion of the drawer by resisting an urging of the drawer by the object inserted into the carton past the first tab edge of the first carton panel.

According to yet another feature, the second tab resists the sliding motion of the drawer past the second tab when the drawer is urged toward the mouth of the carton by a gravitational force, a centrifugal force, a shaking force, or any combination of two or more of the gravitational force, the centrifugal force, and the shaking force.

According to yet another feature, the package system further comprises a bulkhead panel, the bulkhead panel spaced apart from and opposing the first carton panel and positioned between the first carton panel and the first drawer panel when the drawer is slidingly engaged with the carton, the bulkhead panel comprising an aperture, defined by interior edges of the bulkhead panel, the aperture substantially aligned with and having substantially a same size as the first tab.

According to yet another feature, the carton is manufactured as a one-piece cut blank and the bulkhead panel is spaced apart from the first carton panel by space reservation panel that is an integral piece of the one-piece cut blank.

According to yet another feature, the bulkhead panel is spaced apart from the first carton panel by a distance that is equal to or greater than a width ($W_{TE}$) of the first tab and the width ($W_{TE}$) of the first tab is measured perpendicularly to a first tab fold-line, between the first tab fold-line and a point on the first tab edge that is distal to the first tab fold-line.

According to another aspect, a method of manufacturing a package system is provided. The method includes cutting a first one-piece blank having a first plurality of panels including a first carton panel with a first tab, a second carton panel, and a third carton panel; folding the first plurality of panels into a carton having the first carton panel opposing the second carton panel, the third carton panel adjoined between the first carton panel and the second carton panel, and the carton having a carton length ($L_C$) that is defined as a first distance parallel to the third carton panel between the first carton panel and the second carton panel; cutting a second one-piece blank having a second plurality of panels including a first drawer panel, a second drawer panel, and a third drawer panel; and folding the second plurality of panels into a drawer having the first drawer panel opposing the second drawer panel, the third drawer panel adjoined between the first drawer panel and the second drawer panel, and the drawer having a drawer length ($L_D$) that is defined as a second distance parallel to the third carton panel and between the first drawer panel and the second drawer panel, wherein, in a state in which the drawer is slidingly engaged with the carton, the second drawer panel remains within the carton when the first drawer panel is spaced apart from the first carton panel by a safety length ($L_S$) that is defined as a maximum length of an object that, upon insertion of the object into the carton past a first tab edge of the first tab of the first carton panel, causes the second drawer panel to be situated within an interior of the carton and juxtaposed with a plane defined by a mouth of the carton that is proximal to the second carton panel.

According to one feature, the first plurality of panels further includes a bulkhead panel spaced apart from the first carton panel and adjoined to the first carton panel by a space reservation panel, the method further comprising: folding the first plurality of panels into the carton, wherein, in the state in which the drawer is slidingly engaged with the carton, the bulkhead panel is situated between the first carton panel and the first drawer panel.

According to another feature, the third carton panel includes a second tab, further comprising: inserting the drawer into the carton, past the second tab; deflecting the second tab into the carton; and placing the second carton panel into a closed state to enclose the drawer within the carton.

According to yet another feature, the method further comprises placing a product into the drawer prior to inserting the drawer into the carton.

BRIEF DESCRIPTION OF THE DRAWINGS

In FIG. 6A, a second tab is depicted in an inwardly deflected state and a first tab is intact.

In FIG. 6B, the second tab is depicted in an inwardly deflected state and the first tab is also depicted in an inwardly deflected state.

DETAILED DESCRIPTION

In the following description, specific details are given to provide a thorough understanding of the described implementations. However, it will be understood by one of ordinary skill in the art that the implementations may be practiced without these specific details. For example, certain aspects may be illustrated with simplified representations in order not to obscure the implementations in unnecessary detail. In other instances, well-known techniques may be shown in in broad block form in order not to obscure the described implementations.

The x, y, z coordinate system illustrated herein has an origin (0,0,0) at a left-bottom-rear corner of the three-dimensional views (e.g., folded state isometric views) and two dimensional views (e.g., unfolded "die line" views, package system plan and elevation views) as observed when looking at each of a drawer and a carton in a front elevation view. The words "top," "bottom," "right," "left," "rear," and "front" are terms of orientation that are relevant to one another. For example, portions of the carton and drawer that are referred to herein as a top and a bottom may be alternatively be referred to as a bottom and a top, respectively. For ease of orientation, each of the drawings herein are depicted with a unit vector representation of the x, y, z coordinate system (or any two of them for two-dimensional plan and elevation drawings). Select ones of the drawings include the words "TOP" and "BOTTOM" for ease of orienting the drawings and establishing a common plane of reference within the drawings. For consistency, top is referred to as "first," bottom is referred to as "second," right is referred to as "third," left is referred to as "fourth," rear (e.g., floor) is referred to as "fifth," and front (e.g., lid) is referred to as "sixth."

Aspects are described and illustrated herein using exemplary elongated rectangles having six sides or "panels" (i.e., top, bottom, right, left, rear, and front). It will be understood that these aspects are exemplary and not limiting. A fewer number of sides or "panels" (e.g., three sides for an elongated circle (e.g., a cylinder) with an endcap side at each end or five sides for an elongated triangle with an endcap side at each end) or a greater number of sides or "panels" (e.g., ten sides for an elongated octagon with an endcap side at each end), as well as complex shapes (e.g., elongated concave and convex polygons) are within the scope of the disclosure.

Overview

Figure 1:
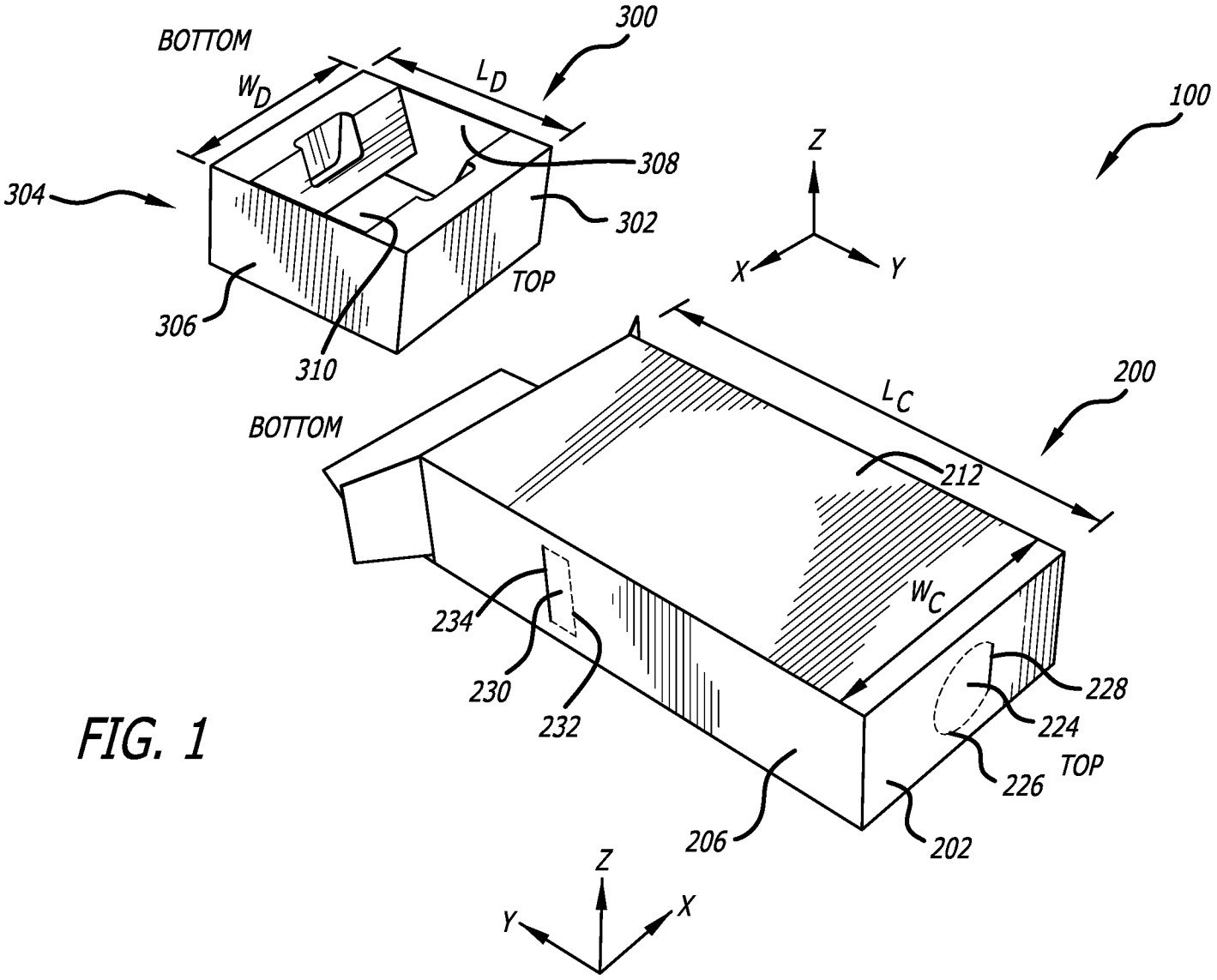
FIG. 1 is an isometric right-front-top view of a package system in accordance with aspects described herein.

FIG. 1 is an isometric right-front-top view of a package system 100 in accordance with aspects described herein. The package system 100 may be a tamper-evident, tamper-resistant, or tamper-evident and tamper-resistant package system. The package system 100 may include a carton 200 and a drawer 300.

Figure 2:
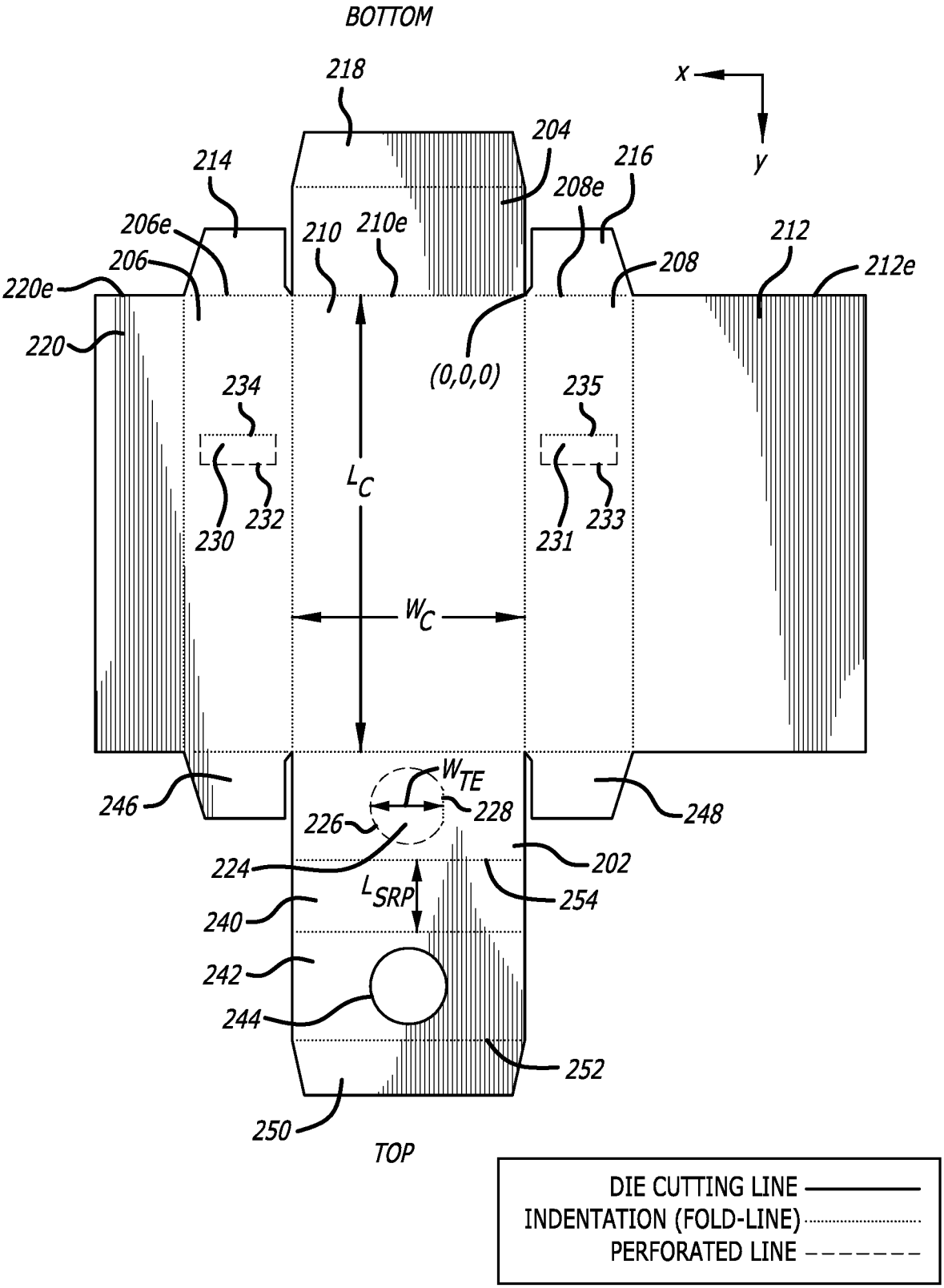
FIG. 2 is a line drawing of a first plurality of panels that may together form the carton of FIG. 1.

FIG. 2 is a line drawing of a first plurality of panels that may together form the carton 200 of FIG. 1. FIG. 2 illustrates the interrelatedness of each of the first plurality of panels to one another. The first plurality of panels may all be joined, directly or indirectly, to one another. The panels of the first plurality of panels are integral to a one-piece carton blank that may be cut according to the line drawing of FIG. 3. A solid line is representative of a cut-line, a dashed line is representative of a perforated line or a row of perforations, and a dotted line is representative of a fold-line. The line drawing may be, for example, a die-cut line drawing, a laser-cut line drawing, a punch-press line drawing, or any combination thereof. The text associated with FIG. 2 recites the names of each of first plurality of panels as they will be referred to herein.

Figure 3:
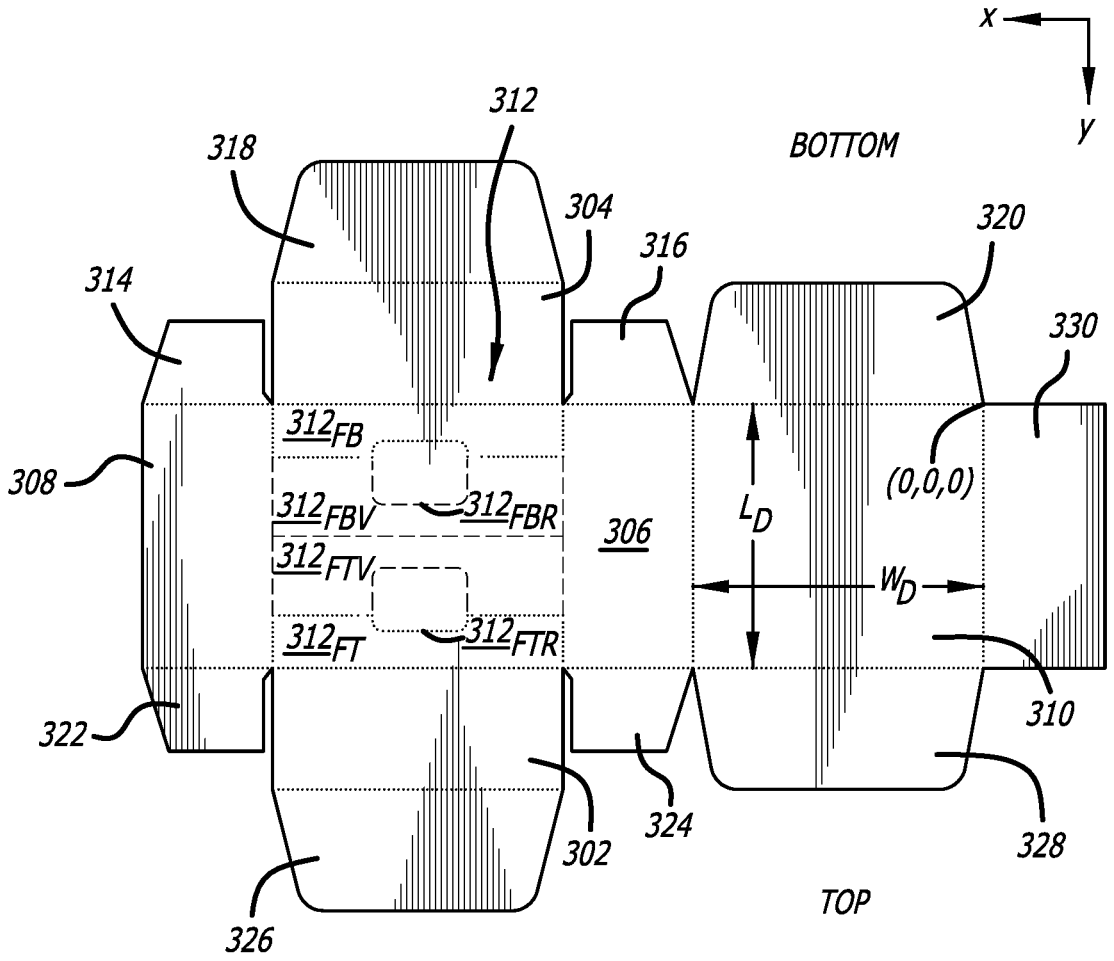
FIG. 3 is a line drawing of a second plurality of panels that may together form the drawer of FIG. 1.

FIG. 3 is a line drawing of a second plurality of panels that may together form the drawer 300 of FIG. 1. FIG. 3 illustrates the interrelatedness of each of the second plurality of panels to one another. The second plurality of panels may all be joined, directly or indirectly, to one another. The panels of the second plurality of panels are integral to a one-piece drawer blank that may be cut according to the line drawing of FIG. 3. A solid line is representative of a cut-line, a dashed line is representative of a perforated line or a row of perforations, and a dotted line is representative of a fold-line. The line drawing may be, for example, a die-cut line drawing, a laser-cut line drawing, a punch-press line drawing, or any combination thereof. The text associated with FIG. 3 recites the names of each of the second plurality panels as they will be referred to herein.

According to some aspects, at least one of the one-piece carton blank and the one-piece drawer blank may be made of a material such as paperboard, cardboard, card stock, tear resistant paperboard, tear resistant cardboard, tear resistant card stock, plastic laminated paperboard, plastic laminated cardboard, and plastic laminated card stock. The preceding list is exemplary and non-limiting. The one-piece carton blank and the one-piece drawer blank may be cut (e.g., die-cut, laser-cut, punched) from the same sheet of material or from different sheets of material.

A First Tab, A Tamper-Evident Tab

The package system 100 disclosed herein may include a first tab 224 associated with a first carton panel 202. The first tab 224 may serve as a "tamper-evident" tab. The first tab 224 may be referred to as the first tab 224 and may also be referred to as a tamper-evident first tab 224. The first tab 224 may have two states.

In a first state, a first tab edge 226 (e.g., a first row of perforations or the material between the first row of perforations) remains intact and untorn. In this first state, the first tab 224 is intact and remains in a plane of the first carton panel 202. In this first state, one can determine that the package system 100 has not been tampered with.

In a second state, the first tab edge 226 (e.g., the first row of perforations or the material between the first row of perforations) is torn. The first tab 224 is separated from the first carton panel 202 (except for its connection via the first tab fold-line 228). In this second state, the first tab 224 may be deflected into the carton 200 (into the interior 502 (FIG. 5) of the carton 200). The first tab 224 may be deflected into the carton 200 by rotation or folding about the first tab fold-line 228 (e.g., rotation about a hinge). As used herein, the phrase "deflected into the carton 200" may mean redirected into an interior 502 of the carton 200. In the second state, the first tab 224 may provide evidence of tampering by observing that the material between the perforations in the first tab edge 226 is torn. The first tab 224 may provide evidence of tampering by observing that the material between the perforations in the first tab edge 226 is torn even when the first tab 224 remains in a plane of the first carton panel 202. The first tab 224 may provide evidence of tampering by observing that the material between the perforations in the first tab edge 226 is torn and the first tab 224 is deflected in to the carton 200, deflected out from the carton 200, or missing from the carton 200 (e.g., the first tab 224 is torn off of the first carton panel 202).

The first tab 224 may be integral to the first carton panel 202. According to one aspect, the first tab 224 may have a first tab edge 226 defined by internal walls of the first carton panel 202. According to another aspect, the first tab 224 may be defined by a first tab edge 226 (e.g., a first row of perforations) (e.g., a straight line, a curved line, a C-shaped line, a U-shaped line) that demarcates at least one edge of the first tab 224 and a first tab fold-line 228 that demarcates at least one other edge of the first tab 224. The first tab fold-line 228 may bridge spaced apart ends of the first tab edge 226. The first tab fold-line 228 may be a score line, a depressed line, and/or an embossed line in the surface of the material (e.g., paperboard) that comprises the first carton panel 202 of the carton 200. The first tab fold-line 228 may serve as a hinge of the first tab 224.

According to a first aspect, an overall outline of the edges of the first tab 224 (e.g., an aperture of the first tab 224) may have any shape having a size that permits entry and passage of a finger of an adult. According to a second aspect, an overall outline of the edges of the first tab 224 (e.g., an aperture of the first tab 224) may have any shape having a size that permits entry and passage of, for example, a pencil or pen but is not larger than the pencil or the pen. By way of example and not limitation, the shape of the first tab 224 may be frusto-circular (as in FIG. 1) (e.g., a circle with a straight truncated edge). Other shapes, including but not limited to, for example, rectangular, square, triangular, or any polygonal shape or non-polygonal shape, are within the scope of the disclosure. The first tab 224 may alternatively be a tab of any shape that is completely surrounded by perforations, to allow for the total removal of the first tab 224 from the first carton panel 202 (without having to tear the material of the first carton panel 202 along the first tab fold-line 228). Other types of tamper-evident first tabs, such as an adhesive backed pull-away covering (e.g., made of a plastic, a paper, or a metallic film), which evidences tampering by ripping off part of the labeling beneath or integrated into the pull-away covering are within the scope of the disclosure.

According to some aspects, the first tab 224 may be configured to provide evidence of insertion of an object into the carton 200 past the first tab edge 226 of the first carton panel 202.

A Second Tab, A Tamper-Resistant Tab

The package system 100 disclosed herein may include a second tab 230 associated with a third carton panel 206. The second tab 230 may serve as a "tamper-resistant" tab. The second tab 230 may be referred to as the second tab 230 and may also be referred to as a tamper-resistant second tab 230. The second tab 230 may have two states.

In a first state, a second tab edge 232 (e.g., a second row of perforations or the material between perforations in the second row of perforations) remains intact and untorn. In this first state, the second tab 230 is intact and remains in a plane of the third carton panel 206. In this first state, one can slidably engage a drawer 300 with the carton 200 and slide the drawer 300 into the carton 200 from a mouth 504 of the carton 200 that is distal to the first carton panel 202 toward the first carton panel 202. If a bulkhead panel 242 is present, the drawer 300 may contact the bulkhead panel 242. If a bulkhead panel 242 is not present, the drawer 300 may contact the first carton panel 202. In either case, the drawer 300, or more particularly the second drawer panel 304, may slide past the second tab 230, from the mouth 504 of the carton 200 that is distal to the first carton panel 202 toward the first carton panel 202.

In a second state, the second tab edge 232 (or the material between perforations in the second row of perforations) is torn. The second tab 230 is separated from the third carton panel 206 (except for its connection via the second tab fold-line 234). In the second state, the second tab 230 may be deflected into the carton 200 (into the interior 502 of the carton 200). The second tab 230 may be deflected into the carton 200 by rotation or folding about the second tab fold-line 234 (e.g., rotation about a hinge). As used herein, the phrase "deflected into the carton 200" may mean redirected into an interior 502 of the carton 200. In the second state, the drawer 300 meets with resistance caused by the second tab 230, which is in an inwardly deflected state, as the drawer 300 is urged back out of the carton 200, toward the mouth 504 of the carton 200, from an end of the carton 200 that is proximal to the first carton panel 202 toward an end of the carton that is distal to the first carton panel 202 ((e.g., the end defining the mouth 504 of the carton 200), from the interior 502 of the carton 200 by an object inserted into the carton 200 through the first tab 224 of the first carton panel 202.

The second tab 230 may be integral to the third carton panel 206. According to one aspect, the second tab 230 may have a second tab edge 232 defined by internal walls of the third carton panel 206. According to another aspect, the second tab 230 may be defined by a second tab edge 232 (e.g., a second row of perforations) (e.g., a straight line, a curved line, a C-shaped line, a U-shaped line) that demarcates at least one edge of the first tab 224 and a first tab fold-line 228 that demarcates at least one other edge of the first tab 224. The first tab fold-line 228 may bridge spaced apart ends of the first tab edge 226. The second tab fold-line 234 may be a score line, a depressed line, and/or an embossed line in the surface of the material (e.g., paperboard) that comprises the carton 200. The second tab fold-line 234 may serve as a hinge of the second tab 230.

According to a first aspect, an overall outline of the edges of the second tab 230 (e.g., an aperture of the second tab 230) may have any shape having a size that permits a deflection of the second tab 230 into the carton 200. In other words, any shape having a size that permits the second tab 230 to fold back upon itself, into the interior 502 of the carton 200. By way of example and not limitation, the shape of the second tab 230 may be rectangular (as in FIG. 1). Other shapes, including but not limited to, for example, square, triangular, or any polygonal shape or non-polygonal shape, are within the scope of the disclosure. According to some aspects, the second tab edge 232 may be a cut-line (e.g., a continuous cut that penetrates through the material without a row of perforations). A continuous cut that penetrates through the material without a row of perforations might be made during a cutting process or cutting operation. Examples of a cutting process or cutting operation include, without limitation, die-cutting, laser-cutting, punch-press-cutting, or any combination thereof.

According to some aspects, the second tab 230 may be configured to provide resistance to a sliding motion of a drawer 300 that is slidingly engaged with the carton 200.

According to one aspect, the second tab 230 may resist a sliding motion (e.g., a translation along the y-axis) of the drawer 300 from the first end of the carton 200 that is proximal to the first carton panel 202 toward the second end of the carton 200 that is distal to the first carton panel 202 by having: a first orientation that is in the interior 502 of the carton 200 and parallel to (or substantially parallel to) the second drawer panel 304, and a subsequent second orientation that is in the interior 502 of the carton 200, parallel to, and between the third carton panel 206 and the third drawer panel 306.

When the second tab 230 is deflected into the carton 200 and folded back upon itself, the second tab 230 reduces a width of the interior 502 of the carton 200 by doubling the panel thickness of the carton 200 in a region of the carton 200 adjacent to the second tab 230. The doubled thickness increases resistance to the sliding motion of the drawer 300 by narrowing the passageway through which the drawer 300 slides.

Figure 5:
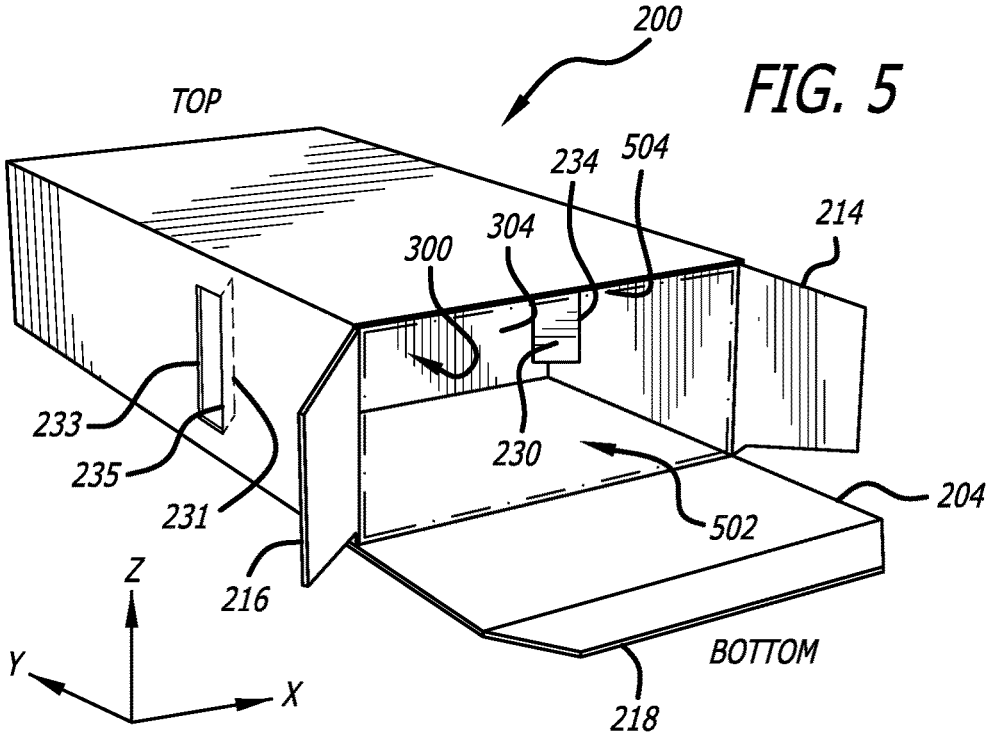
FIG. 5 is a bottom-left-front isotropic view of the package system of FIG. 1, where the drawer is slidingly engaged with the carton and is positioned proximal to the first carton panel.

When folded into a carton-shape, and using FIG. 5 for exemplary and non-limiting purposes, the mouth 504 of the carton 200 may be defined at least by edges 206*e*, 208*e*, 210*e*, and 212*e*, of third carton panel 206, fourth carton panel 208, fifth carton panel 210, and sixth carton panel 212, respectively. When folded into the carton 200 shape, using FIG. 5 for exemplary and non-limiting purposes, edge 212*e* of the sixth carton panel 212 and edge 220*e* of the front sealing panel 220 may define a single edge. Although depicted as a rectangle in the exemplary figures contained herein, the mouth 504 of the carton 200 may be any shape and may occupy a one-dimensional plane or a multi-dimensional plane.

A Third Tab, A Tamper-Resistant Tab

In aspects where the first plurality of panels of the carton 200 further includes a fourth carton panel 208 with a third tab 231, a third tab edge 233 (e.g., a third row of perforations, the material between perforations in the third row of perforations, or cut-line), and a third tab fold-line 235, the characteristics described throughout this disclosure with respect to the second tab 230, second tab edge 232, and second tab fold-line 234 apply equally to the third tab 231, third tab edge 233, and third tab fold-line 235, respectively. A more detailed discussion of the second tab 230 and third tab 231 is contained in the passages that follow. In this disclosure, the second tab 230 may be referred to as the second tab 230 and can also be referred to as a tamper-resistant second tab 230; the third tab 231 may be referred to as the third tab 231 and can also be referred to as a tamper-resistant third tab 231.

First Description of a Package System

Returning again to FIG. 1, as mentioned, FIG. 1 is an isometric right-front-top view of a package system 100 according to aspects described herein. The package system 100 may be a tamper-evident, tamper-resistant, or tamper-evident and tamper-resistant package system. The package system 100 may include a carton 200 and a drawer 300.

In a first aspect, the package system 100 may include a carton 200 having a first plurality of panels that encloses and defines an interior 502 of the carton 200 (e.g., a space within the carton 200, a cavity within the carton 200) and separates the interior 502 of the carton 200 from an exterior of the carton 200 (e.g., a space outside of the carton 200). The first plurality of panels may include a first carton panel 202 with a first tab 224, a second carton panel 204 opposing the first carton panel 202, and a third carton panel 206. The third carton panel 206 may include a second tab 230. The third carton panel 206 may be adjoined (e.g., coupled directly or indirectly and may be formed form a single one-piece blank) between the first carton panel 202 and the second carton panel 204. A carton length ($L_C$) of the carton 200 may be defined by a first distance between the first carton panel 202 and the second carton panel 204 as measured along an axis parallel to the third carton panel 206 (e.g., the y-axis). The carton length ($L_C$) may be equal to the length of the third carton panel 206.

The package system 100 may include a drawer 300 configured to slide into and out of the interior 502 of the carton 200 along the axis parallel to the third carton panel 206 (e.g., the y-axis). The drawer 300, as (or when) positioned within the interior 502 of the carton 200, may have a first drawer panel 302 opposing the first carton panel 202, a second drawer panel 304 opposing the first drawer panel 302 and the second carton panel 204, and a third drawer panel 306 adjoined between the first drawer panel 302 and the second drawer panel 304. The third drawer panel 306 may oppose the third carton panel 206. The third drawer panel 306 may be parallel to the third carton panel 206. A drawer length ($L_D$) of the drawer 300 may be defined by a second distance between the first drawer panel 302 and the second drawer panel 304 as measured along the axis parallel to the third carton panel 206 (e.g., the y-axis), or as measured along the axis parallel to the third drawer panel 306 (e.g., when the axis of the third carton panel 206 is not parallel to the axis of the third drawer panel).

According to aspects described herein, the carton length ($L_C$) may be greater than or equal to a safety length ($L_S$) (see FIG. 9) plus the drawer length ($L_D$). This may be expressed in equation form as $L_C \geq L_S + L_D$. The safety length ($L_S$) of a package system 100 may be given or measured, for example, as a spaced apart distance between the first carton panel 202 and the first drawer panel 302 in a state in which the second drawer panel 304 is in the interior 502 of the carton 200 and juxtaposed to a mouth 504 (FIG. 5) of the carton 200 (e.g., juxtaposed to a plane coincident with the mouth 504 of the carton 200). When folded into a carton-shape, and using FIG. 5 for exemplary and non-limiting purposes, the mouth 504 of the carton 200 may be defined at least by edges 206*e*, 208*e*, 210*e*, and 212*e* (see FIG. 2), of third carton panel 206, fourth carton panel 208, fifth carton panel 210, and sixth carton panel 212, respectively. In other words, the mouth 504 of the carton 200 may be defined by edges of the carton 200 that are proximal to the second carton panel 204 (in a closed state) and distal to respective edges of the first carton panel 202. When folded into the carton 200 shape, using FIG. 5 for exemplary and non-limiting purposes, edge 212*e* of the sixth carton panel 212 and edge 220*e* of the front sealing panel 220 may define a single edge. Although depicted as a rectangle in the exemplary figures contained herein, the mouth 504 of the carton 200 may be any shape and may occupy a one-dimensional plane or a multi-dimensional plane.

The safety length ($L_S$) may be a length of an object (e.g., a maximum length of an object) that, when inserted into the carton 200 through the first carton panel 202 does not cause an expulsion of any part of the drawer 300 from the mouth 504 of the carton 200. According to some aspects, the object may be, for example, a child's middle finger (the longest finger of a child's hand).

Knowledge of the safety length ($L_S$) of a package system 100 as described herein, along with a knowledge of an average length of a middle finger of a child (the longest finger of a child) as a function of age, allows a package designer to quantify an age group for which the package system 100 may be deemed safe.

Research has been compiled that provides tables and charts identifying an average length of a middle finger of a child as a function of age. Of particular note is the document titled *Anthropometry of Infants, Children, and Youths to Age 18 for Product Safety Design*, Final Report May 31, 1977 by Richard G. Snyder et al. (May 1977) (hereinafter "*Snyder_1977_Child*"). A copy of *Snyder_1977_Child* is available via the Internet at http://mreed.umtri.umich.edu/mreed/downloads/anthro/child/Snyder_1977_Child.pdf. Of particular note are pages 292-295, which include a section headed "Middle Finger Length". A copy of the table on page 293 of *Snyder_1977_Child* is reproduced below. The table presents the results of measurements of the middle finger length of children of ages 2-19. By way of example and not limitation, *Snyder_1977_Child* indicates that for male and female children between the ages of 6.5-7.5 years, an average length of a middle finger of a child is about 5.8 cm (58 mm) (identified as a "mean" length in the following chart reproduced from *Snyder_1977_Child*).

| Middle Finger Length (cm) (males and females) | | | | | | | | |
|---|---|---|---|---|---|---|---|---|
| Age (yrs) | N | Mean | s.d. | Min | $5^{th}$ | $50^{th}$ | $95^{th}$ | Max |
| 2.0-3.5 | 74 | 4.4 | 0.4 | 3.5 | 3.8 | 4.3 | 5.2 | 5.5 |
| 3.5-4.5 | 71 | 4.8 | 0.4 | 3.9 | 4.2 | 4.8 | 5.5 | 5.7 |
| 4.5-5.5 | 94 | 5.1 | 0.4 | 4.4 | 4.4 | 5.0 | 5.6 | 6.0 |
| 5.5-6.5 | 62 | 5.4 | 0.4 | 4.5 | 4.6 | 5.3 | 6.2 | 6.5 |
| 6.5-7.5 | 63 | 5.8 | 0.4 | 4.7 | 5.1 | 5.8 | 6.3 | 6.7 |
| 7.5-8.5 | 60 | 5.9 | 0.4 | 5.0 | 5.1 | 5.8 | 6.5 | 6.6 |
| 8.5-9.5 | 79 | 6.2 | 0.4 | 5.5 | 5.6 | 6.1 | 7.0 | 7.2 |
| 9.5-10.5 | 93 | 6.5 | 0.5 | 5.1 | 5.8 | 6.4 | 7.2 | 8.0 |
| 10.5-11.5 | 98 | 6.7 | 0.5 | 5.2 | 5.9 | 6.6 | 7.7 | 7.9 |
| 11.5-12.5 | 94 | 7.0 | 0.5 | 5.6 | 6.0 | 7.0 | 7.8 | 8.3 |
| 12.5-13.5 | 107 | 7.3 | 0.5 | 6.0 | 6.4 | 7.2 | 8.2 | 8.9 |
| 13.5-14.5 | 98 | 7.5 | 0.6 | 6.3 | 6.6 | 7.4 | 8.6 | 9.4 |
| 14.5-15.5 | 95 | 7.8 | 0.6 | 6.7 | 6.7 | 7.7 | 8.6 | 9.2 |
| 15.5-16.5 | 56 | 7.9 | 0.6 | 6.5 | 6.9 | 7.8 | 8.8 | 9.1 |
| 16.5-17.5 | 80 | 7.8 | 0.6 | 6.2 | 6.6 | 7.8 | 8.6 | 9.3 |
| 17.5-19.0 | 46 | 8.1 | 0.6 | 6.8 | 7.0 | 8.1 | 9.0 | 9.1 |

A package designer might use this type of information to determine the safety length ($L_S$) of a package system 100 as described and exemplified herein. For example, if one wanted to design a package system that may be deemed safe for a child in an age range of 6.5-7.5 years and younger, one could determine, from the table above (for example) that the middle finger length of a child age 6.5-7.5 years was 5.8 cm (58 mm). One could then set the safety length ($L_S$) to 58 mm. One might next determine the drawer length ($L_D$), which may be based, in part, on the dimensions of the product to be stored in the drawer 300. For exemplary and non-limiting purposes, we can take 4 cm (40 mm) as the drawer length ($L_D$) of the drawer 300. Knowledge of the safety length ($L_S$) and drawer length ($L_D$) could be applied to the equation provided above to determine the carton length ($L_C$). In this example, $L_C \geq L_S + L_D$, therefore $L_C \geq (58\text{ mm} + 40\text{ mm})$ or $L_C \geq 98$ mm. Knowledge of any two of the variables $L_C$, $L_S$, or $L_D$ can be used to derive the remaining variable. For example, a first reordering the preceding formula provides $L_S \leq L_C - L_D$. For example, a second reordering the preceding formula provides $L_D \leq L_C - L_S$. A safety length ($L_S$) thus selected that would preclude an ability of a child of the given age or younger from urging (e.g., pushing, forcing, compelling) the drawer 300 from the carton 200. Accordingly, one might capitalize on the size of a child's middle finger to design package systems, such as the package system 100 described herein, that are safe for children of a given age and younger.

Using the example given above, even if a child of age 6.5-7.5 years or less stuck the full length of his or her middle finger into the carton 200 through the first tab 224 (e.g., tamper-evident first tab 224) of the first carton panel 202, that finger would not be long enough to urge (e.g., push, force, compel) any portion of the drawer 300 out of the carton 200. Therefore, the package may be deemed safe for children of age 6.5-7.5 years or less.

In still other words, the safety length ($L_S$) may preclude expulsion (e.g., a process of forcing a thing, like the drawer 300, out of the interior 502 of the carton 200) of any portion of the drawer 300 from the carton 200 by reason of (e.g., as a result of) insertion into the interior 502 of the carton 200, through the first carton panel 202 (or through the first tab 224 of the first carton panel 202) of an object having a length that is less than or equal to the safety length ($L_S$).

According to some aspects, the carton 200 of the package system 100 may have at least six panels that define and enclose the interior 502 of the carton 200 and separate the interior 502 of the carton 200 from an exterior of the carton 200. The six panels may include, for example, the first carton panel 202 with the first tab 224, the second carton panel 204 opposing the first carton panel 202, and the third carton panel 206. The third carton panel 206 may include a second tab 230. The third carton panel 206 may be adjoined between the first carton panel 202 and the second carton panel 204.

According to some aspects, the second carton panel 204 of the package system 100 may be configured to at least one of provide access to (e.g., in an open state) and block access to (e.g., in a closed state) the interior 502 of the carton 200. In other words, the second carton panel 204 may be configured to open and/or close an end of (e.g., a mouth of) the carton 200. The end of the carton 200 may be that end of the carton 200 that is distal to the first carton panel 202.

According to some aspects, tampering with the contents of the carton 200, including the contents of the drawer 300 within the carton 200, may be evidenced by torn material (e.g., torn paperboard) between perforations of the first tab edge 226.

According to some aspects, insertion of the object into the interior 502 of the carton 200 may be evidenced by deflection of the first tab 224 into or out of (e.g., away from) the interior 502 of the carton 200, or by removal of the first tab 224 from the carton 200.

According to some aspects, the object may be a finger, and the safety length ($L_S$) may be an average length of a middle finger of a child. According to some aspects, the average length of the middle finger of the child is about 58 mm.

The package system 100 may further include a fourth carton panel 208 with a third tab 231 (e.g., a tamper-resistant third tab 231), the fourth carton panel 208 may oppose and may be parallel to the third carton panel 206 and may be adjoined between the first carton panel 202 and the second carton panel 204. A description of the third tab 231, third tab edge 233, and third tab fold-line 235 corresponds to the description of the second tab 230, second tab edge 232, and second tab fold-line 234, respectively given hereinabove and will not be repeated here for the sake of brevity. Similar to the second tab 230, when the third tab 231 is deflected into the interior 502 of the carton 200, the third tab 231 may resist a sliding motion (e.g., a translation along the y-axis) of the drawer 300 from the first end of the carton 200 that is proximal to the first carton panel 202 toward the second end of the carton 200 that is distal to the first carton panel 202 by having: a first orientation that is in the interior 502 of the carton 200 and parallel to (or substantially parallel to) the second drawer panel 304, and a subsequent second orientation that is in the interior 502 of the carton 200, parallel to, and between the third carton panel 206 and a fourth drawer panel 308.

The package system 100 may further include a bulkhead panel 242 within the interior 502 of the carton 200, the bulkhead panel 242 may be spaced apart from and may opposed the first carton panel 202. The bulkhead panel 242 may be positioned between the first carton panel 202 and a first drawer panel 302 of the drawer 300 when (e.g., in a state in which) the drawer 300 is positioned within the interior 502 of the carton 200. The bulkhead panel 242 may include an aperture 244 (e.g., an opening), defined by interior edges of the bulkhead panel 242, the aperture 244 may be substantially aligned with and may have substantially the same size as the first tab 224 of the first carton panel 202. According to some aspects, the bulkhead panel 242 may be spaced apart from the first carton panel 202 by a space (e.g., a separation distance) reservation panel 240 that may be integral to the first plurality of panels and adjoined between the first carton panel 202 and the bulkhead panel 242. According to some aspects, a length of the space reservation panel 240 (e.g., a space reservation panel length ($L_{SRP}$)), measured along the y-axis, may be equal to or greater than a width ($W_{TE}$) (also referred to as a first-tab-width), measured along an x-axis, of the first tab 224 of the first carton panel 202. That is, $L_{SRP}$ may be equal to or greater than $W_{TE}$ and $W_{TE}$ may be measured perpendicularly to the first tab fold-line 228, between the first tab fold-line 228 and an edge of the first tab 224 that is distal to the first tab fold-line 228. The inclusion of the bulkhead panel 242, spaced apart from the first carton panel 202 by the space reservation panel length ($L_{SRP}$) and opposing the first carton panel 202, reserves a space (e.g., a separation distance) between the first carton panel 202 of the carton 200 and the first drawer panel 302 of the drawer 300. The reserved space may facilitate inward deflection of the first tab 224 and rotation of the first tab 224 about the first tab fold-line 228 (e.g., about a hinge) with minimal if any contact between the first tab 224 and at least one of the first drawer panel 302 and the bulkhead panel 242.

Second Description of a Package System

Returning again to FIG. 1, as mentioned, FIG. 1 is an isometric right-front-top view of a package system 100 according to aspects described herein. The package system 100 may be a tamper-evident, tamper-resistant, or tamper-evident and tamper-resistant package system. The package system 100 may include a carton 200 and a drawer 300.

The carton 200 may be manufactured by folding a first one-piece cut material (e.g., die-cut, laser-cut, punch-press-cut) into an elongated shape having as sides a first plurality of panels including at least a first carton panel 202 and a second carton panel 204 that is spaced apart from and opposing the first carton panel 202. The second carton panel 204 is hidden from view in FIG. 1. The first carton panel 202 and the second carton panel 204 may alternatively be referred to as a top carton panel and a bottom carton panel, respectively. A carton length ($L_C$) of the carton 200 may be defined by a first distance between the first carton panel 202 and the second carton panel 204 (after the carton 200 is fully folded and the first carton panel 202 and the second carton panel 204 are in a closed state according to their design).

The first plurality of panels may further include at least a third carton panel 206 and a fourth carton panel 208 (hidden from view in FIG. 1, see FIG. 2) that is spaced apart from and opposing the third carton panel 206. The third carton panel 206 and the fourth carton panel 208 may be parallel to facilitate the slidable engagement of the drawer 300 within the carton 200. The drawer 300 may slide into and out of the carton 200 along a y-axis (e.g., slide along a length of the carton 200, translation along the y-axis). The third carton panel 206 and the fourth carton panel 208 are depicted in the exemplary illustration of FIG. 1 as lying in planes that intersect corresponding planes of the first carton panel 202 and the second carton panel 204 (when the carton 200 is in a closed state). A carton width ($W_C$) of the carton 200 may be defined by a distance between the third carton panel 206 and the fourth carton panel 208 (when the carton 200 is in a closed state). To facilitate the slidable engagement of the drawer 300 within the carton 200, the carton width ($W_C$) of the carton 200 may remain substantially constant along the carton length ($L_C$) of the carton 200.

The package system 100 may further include a drawer 300. The drawer 300 may be manufactured by folding a second one-piece cut material (e.g., die-cut, laser-cut, punch-press-cut) into a shape having as sides a second plurality of panels including at least a first drawer panel 302 and a second drawer panel 304 (hidden from view in FIG. 1, see FIG. 3) that is spaced apart from and opposes the first drawer panel 302. The first drawer panel 302 and the second drawer panel 304 may alternatively be referred to as a top drawer panel and a bottom drawer panel, respectively). A drawer length ($L_D$) of the drawer 300 may be defined by a second distance between the first drawer panel 302 and the second drawer panel 304 (after the drawer 300 is fully folded and the first drawer panel 302 and the second drawer panel 304 are oriented according to their design).

The second plurality of panels may further include at least a third drawer panel 306 and a fourth drawer panel 308 spaced apart from and opposing the third drawer panel 306. The third drawer panel 306 and the fourth drawer panel 308 may alternatively be referred to as a right-side drawer panel and a left-side drawer panel, respectively. The third drawer panel 306 and the fourth drawer panel 308 may be parallel to facilitate the slidable engagement of the drawer 300 within the carton 200. The drawer 300 may be configured to slide into and out of the carton 200 along the y-axis (e.g., slide along a length of the carton 200, translation along the y-axis).

The third drawer panel 306 and the fourth drawer panel 308 are depicted in the exemplary illustration of FIG. 1 as lying in planes that intersect corresponding planes of the first drawer panel 302 and the second drawer panel 304 (when the carton 200 is in a closed state). A drawer width ($W_D$) of the drawer 300 may be defined by a distance between the third drawer panel 306 and the fourth drawer panel 308 (when the drawer 300 is folded according to its design). To facilitate the slidable engagement of the drawer 300 within the carton 200, the drawer width ($W_D$) of the drawer 300 may remain substantially constant along the length, $L_D$, of the drawer 300.

The carton 200 and the drawer 300 may be manufactured from two pieces of stock material or from one piece of stock material. Additional carton panels and drawer panels are described below in connection with FIG. 2 and FIG. 3, respectively.

According to some aspects, the third drawer panel 306 may be parallel with and adjacent to the third carton panel 206 and the fourth drawer panel 308 may be parallel with and adjacent to the fourth carton panel 208.

Additionally, or alternatively, the package system 100 may include a third tab 231 (e.g., a tamper-resistant third tab 231) associated with the fourth carton panel 208 (where the third tab 231 and the fourth carton panel 208 are hidden from view in FIG. 1, see FIG. 2). The third tab 231 may be similar in form and function to the second tab 230. The descriptions of the second tab 230 and third tab 231 will not be repeated for the sake of brevity.

As described herein, according to one aspect, the carton length ($L_C$) of the carton 200 may be equal to or greater than the drawer length ($L_D$) of the drawer 300 plus a safety length ($L_S$) to preclude expulsion of any portion of the drawer 300 from the carton 200 by reason of (e.g., as a result of) insertion into the carton 200, through the first carton panel 202, of an object having the safety length ($L_S$) or less. The safety length ($L_S$) of a package system 100 may be given or measured, for example, as a spaced apart distance between the first carton panel 202 and the first drawer panel 302 in a state in which the second drawer panel 304 is in the interior 502 of the carton 200 and juxtaposed to a mouth 504 of the carton 200 (e.g., juxtaposed to a plane coincident with the mouth 504 of the carton 200).

According to some aspects, the object may be a finger, and the safety length ($L_S$) may be an average length of a middle finger of a child. According to some aspects, the average length of the middle finger of a child is about 58 mm.

According to some aspects, the second tab 230 (and/or the third tab 231 if one or both are present) precludes (or retards, or acts against) the drawer 300 from sliding out of the carton 200 (e.g., out of the interior 502 of the carton 200) (e.g., when the second carton panel 204 is open and the mouth 504 of the carton 200 is in an open state, in a non-covered state), without being urged by an object inserted through the first carton panel 202 (e.g., through the first tab 224, or through an aperture defined by the edges of the first tab 224), and with being urged by a gravitational force, a centrifugal force, or a combination of the gravitational force and the centrifugal force. In other words, the second tab 230 precludes a person (child or adult) from urging the drawer 300 out from the carton 200 (after opening the second carton panel 204) by holding the carton 200 vertically while waiting for gravity to cause the drawer 300 to fall out of the carton 200 or by grasping the carton 200 at a first end of the carton 200 that is proximal to the first carton panel 202 and shaking and/or rotating the carton 200 by a rapid shaking and/or rotation of the forearm and/or wrist. Centrifugal force may be applied, for example, by grasping the carton 200 at the first end of the carton 200 that is proximal to the first carton panel 202 and rapidly rotating the carton 200 by rapid rotation of the wrist and/or forearm. The centrifugal force may be an apparent force that acts outward on the drawer 300 moving around a center (e.g., the center of rotation of the wrist), arising from the drawer's inertia.)

According to some aspects, the package system 100 may provide an additional tamper-resistant aspect comprising a reserved volume (e.g., an unoccupied volume, an empty space) defined by six panels or portions of panels or any combination thereof, between the second drawer panel 304 and the mouth 504 of the carton 200. According to some aspects, the drawer 300 presents a featureless side toward the reserved volume. According to some aspects, a feature (such as, for example, a tab, a string, an aperture) that could allow for the drawer 300 to be gripped and/or pulled from the interior 502 of the carton 200 is absent from the side of the drawer 300 facing the reserved volume. The drawer 300 presents a featureless side toward the reserved volume. According to some aspects, the reserved volume has a length that is equal to or greater than a length that would permit a child to insert fingers into the reserved volume to retrieve the drawer 300 from the interior 502 of the carton 200.

According to some aspects, deflection of the second tab 230 (and/or the third tab 231) into the carton 200, reduces a width of the carton 200 and provides resistance against a sliding motion (e.g., a translation along the y-axis) of the drawer 300 sliding past the second tab 230 (and/or the third tab 231) toward a mouth 504 of the carton 200.

According to one aspect, the second tab 230 doubles a thickness of the third carton panel 206 in a local area defined by a projection of the second tab 230 on the third carton panel 206 when the second tab 230 is forced, by motion of the drawer 300, to fold back upon itself, and is held against the third carton panel 206, between the third carton panel 206 and the third drawer panel 306, by motion of the drawer 300 sliding past the second tab 230.

According to one aspect, the package system 100 may further include a bulkhead panel 242. The bulkhead panel 242 was previously described and will not be repeated for the sake of brevity.

Third Description of a Package System

Returning again to FIG. 1, as mentioned, FIG. 1 is an isometric right-front-top view of a package system 100 according to aspects described herein. The package system 100 may be a tamper-evident, tamper-resistant, or tamper-evident and tamper-resistant package system. The package system 100 may include a carton 200 having a first plurality of panels. The first plurality of panels may include a first carton panel 202 including a first tab 224 (that may be referred to as a tamper-evident first tab 224), a second carton panel 204 opposing the first carton panel 202, and a third carton panel 206 adjoined between the first carton panel 202 and the second carton panel 204.

The package system 100 may further include a drawer 300, slidingly engaged with the carton 200 (as shown, for example, in FIG. 4), the drawer 300 may have a second plurality of panels including at least a first drawer panel 302 opposing the first carton panel 202, a second drawer panel 304 opposing the second carton panel 204 (when the carton 200 is in a closed state), and a third drawer panel 306 opposing the third carton panel 206, the third drawer panel 306 adjoined between the first drawer panel 302 and the second drawer panel 304 and opposing the third carton panel 206.

According to one aspect, the carton length ($L_C$) may be defined as a first distance parallel to the third carton panel 206 between the first carton panel 202 and the second carton panel 204. The first distance parallel to the third carton panel 206 between the first carton panel 202 and the second carton panel 204 may be a greatest distance between the first carton panel 202 and the second carton panel 204. The drawer length ($L_D$) may be defined as a second distance parallel to the third drawer panel 306 between the first drawer panel 302 and the second drawer panel 304. The second distance parallel to the third drawer panel 306 between the first drawer panel 302 and the second drawer panel 304 may be a greatest distance between the first drawer panel 302 and the second drawer panel 304. A safety length ($L_S$) of the package system 100 may be defined as a maximum length of an object used to urge (e.g., push, force, compel) any portion of the second drawer panel 304 past a mouth 504 of the carton 200, after the second carton panel 204 is at least one of rotated away from or removed from the mouth 504 of the carton 200, upon insertion of the object into the carton 200 past the edge of the first tab 224 of the first carton panel 202 (where an example of an object so inserted is exemplified by a finger of a child's hand in FIG. 9). According to such an aspect, $L_C \geq L_S + L_D$. When folded into a carton-shape, and using FIG. 5 for exemplary and non-limiting purposes, the mouth 504 of the carton 200 may be defined at least by edges 206*e*, 208*e*, 210*e*, and 212*e*, of third carton panel 206, fourth carton panel 208, fifth carton panel 210, and sixth carton panel 212, respectively. When folded into the carton 200 shape, using FIG. 5 for exemplary and non-limiting purposes, edge 212*e* of the sixth carton panel 212 and edge 220*e* of the front sealing panel 220 may define a single edge. Although depicted as a rectangle in the exemplary figures contained herein, the mouth 504 of the carton 200 may be any shape and may occupy a one-dimensional plane or a multi-dimensional plane.

According to some aspects, the safety length ($L_S$) of the package system 100 may be an average length of a middle finger of a child.

Descriptions of the second tab 230 and third tab 231 were previously provided and are not repeated for the sake of brevity. Tabs such as the second tab 230, the third tab 231, and the like may be associated with, or integral to, the third carton panel 206 (e.g., a right-side carton panel), the fourth carton panel 208 (e.g., a left-side carton panel), a fifth carton panel 210 (e.g., a rear or floor carton panel), a sixth carton panel 212 (e.g., a lid or cover carton panel), or any combination thereof. Inclusion of one or more tabs (e.g., tamper-resistant tabs) on one, more than one, or all of the third carton panel 206, fourth carton panel 208, fifth carton panel 210, or sixth carton panel 212 is within the scope of the disclosure. Location of one or more tabs (e.g., tamper-resistant tabs) on the fifth carton panel 210 and/or sixth carton panel 212 may find use when the drawer 300 has a lid against which the tab(s) of the fifth carton panel 210 (e.g., the carton lid) may press and/or where additional resistance from a tab on the sixth carton panel 212 may be desired.

According to some aspects, the second tab 230 (and/or the third tab 231 if one or both are present) resists the movement of the drawer 300 by having: a first orientation that is substantially parallel the second drawer panel 304 when the second drawer panel 304 is adjacent (see, for example, FIG. 8) to the second tab fold-line 234, and a subsequent second orientation that is parallel to and between the third carton panel 206 and the third drawer panel 306 when the third drawer panel 306 is adjacent to the second tab fold-line 234.

According to some aspects, the second tab 230 (and/or the third tab 231 if one or both are present) resists a sliding of the drawer 300 past the second tab 230 (or the third tab 231 or both if present), without being urged by an object inserted through the first carton panel 202, and with being urged by a gravitational force, a centrifugal force, a shaking force, or any combination of two or more of the gravitational force, the centrifugal force, and the shaking force.

According to one aspect, the package system 100 may further include a bulkhead panel 242. The bulkhead panel 242 was previously described and will not be repeated for the sake of brevity.

Fourth Description of a Package System

Returning still again to FIG. 1, a package system 100 may be a tamper-evident, tamper-resistant, or tamper-evident and tamper-resistant package system. The package system 100 may include a carton 200 having a first carton panel 202 including a first tab 224, a second carton panel 204 opposing the first carton panel 202, and a third carton panel 206 adjoined between the first carton panel 202 and the second carton panel 204. The carton 200 may have a carton length ($L_C$) that may be defined as a first distance parallel to the third carton panel 206, between the first carton panel 202 and the second carton panel 204. The carton length ($L_C$) may be a maximum distance between the first carton panel 202 and the second carton panel 204. The carton length ($L_C$) may be a maximum distance parallel to the third carton panel 206, between the first carton panel 202 and the second carton panel 204.

Figure 4:
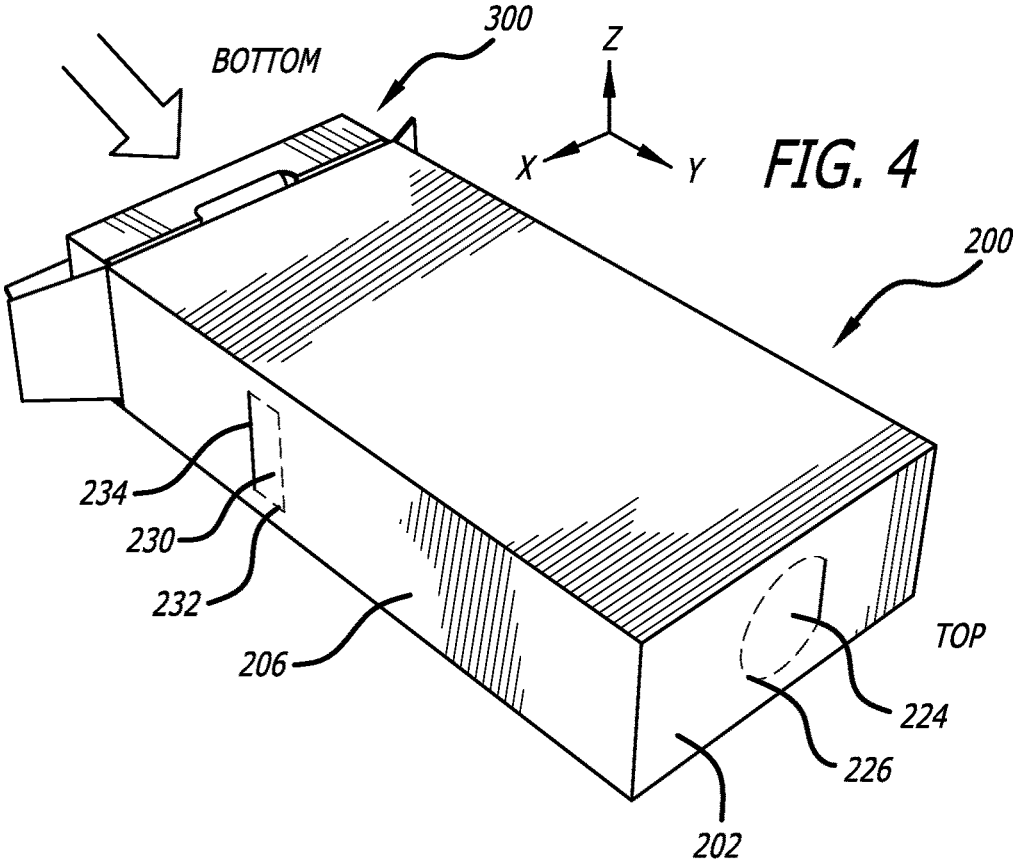
FIG. 4 is an isometric right-front-top view of the package system of FIG. 1, where the drawer is depicted as sliding into the carton, in accordance with aspects described herein.

The package system 100 may further include a drawer 300 configured to slide into and out of an interior of the carton 200 (see, for example, FIG. 4). The drawer 300 may be configured to slide into and out of the interior of the carton 200 along the axis parallel to the third carton panel 206 (e.g., along a longitudinal axis, along the y-axis). The drawer 300 may have (e.g., may be designed to have, or may have in an operational or folded state) at least a first drawer panel 302 opposing the first carton panel 202, a second drawer panel 304 opposing the second carton panel 204, and a third drawer panel 306 opposing the third carton panel 206, the third drawer panel 306 may be adjoined between the first drawer panel 302 and the second drawer panel 304. The drawer 300 may have a drawer length ($L_D$) that may be defined as a second distance parallel to the third drawer panel 306 between the first drawer panel 302 and the second drawer panel 304. The drawer length ($L_D$) may be a maximum distance between the first drawer panel 302 and the second drawer panel 304. The drawer length ($L_D$) may be a maximum distance parallel to the third drawer panel 306, between the first drawer panel 302 and the second drawer panel 304.

According to some aspects (e.g., in a state in which the drawer 300 is slidingly engaged with the carton 200, in an operational state), the second drawer panel 304 may remain within the carton 200 (e.g., within the interior of the carton 200) when (e.g., while, in a state in which) the first drawer panel 302 is spaced apart from the first carton panel 202 by a safety length (LS) (see, e.g., FIG. 9) that may be defined as a maximum length of an object that, upon insertion of the object into the carton 200 past the first tab edge 226 of the first carton panel 202, causes the second drawer panel 304 to be situated within the interior 502 of the carton 200 (e.g., be positioned within the carton 200) and juxtaposed with (e.g., placed side-by-side with, parallel with and tangential to, parallel with and adjacent to) a plane defined by a mouth 504 of the carton 200 that is proximal to the second carton panel 204 (e.g., when the second carton panel 204 is in a closed state). When folded into a carton-shape, and using FIG. 5 for exemplary and non-limiting purposes, the mouth 504 of the carton 200 may be defined at least by edges 206*e*, 208*e*, 210*e*, and 212*e*, of third carton panel 206, fourth carton panel 208, fifth carton panel 210, and sixth carton panel 212, respectively. When folded into the carton 200 shape, using FIG. 5 for exemplary and non-limiting purposes, edge 212*e* of the sixth carton panel 212 and edge 220*e* of the front sealing panel 220 may define a single edge. Although depicted as a rectangle in the exemplary figures contained herein, the mouth 504 of the carton 200 may be any shape and may occupy a one-dimensional plane or a multi-dimensional plane.

The carton 200 may include a first plurality of panels including the first carton panel 202, the second carton panel 204, and the third carton panel 206, and the first plurality of panels may enclose and define the interior 504 of the carton 200.

According to some aspects, the safety length ($L_S$) of the package system 100 may be an average length of a middle finger of a child.

According to some aspects, the drawer 300 may be configured to slide into and out of the interior 504 of the carton 200 along an axis parallel to the third carton panel 206 (e.g., a longitudinal axis, the y-axis).

According to some aspects, the package system 100 may further include a second tab 230 included with the third carton panel 206 and having a second tab edge 232 (e.g., a second row of perforations or a second cut-line) (e.g., a straight line, a curved line, a C-shaped line, a U-shaped line) defined by internal walls of the third carton panel 206 and a second tab fold-line 234. The second tab 230 may fold (e.g., may be configured to fold) toward an interior 504 of the carton 200 along (e.g., around, about) the second tab fold-line 234.

According to some aspects, the package system 100 may further include a third tab 231 included with the fourth carton panel 208 and having a third tab edge 233 (e.g., a third row of perforations, the material between perforations in the third row of perforations, or a third cut-line) (e.g., a straight line, a curved line, a C-shaped line, a U-shaped line) defined by internal walls of the fourth carton panel 208 and a third tab fold-line 235. The third tab 231 may fold (e.g., may be configured to fold) toward an interior 504 of the carton 200 along (e.g., around, about) the third tab fold-line 235.

According to some aspects, the second tab edge 232 may be demarcated by at least one of a cut-line or a second row of perforations. The second tab fold-line 234 may bridge spaced apart ends of the second tab edge 232. According to some aspects, the third tab edge 233 may be demarcated by at least one of a cut-line or a third row of perforations. The third tab fold-line 235 may bridge spaced apart ends of the third tab edge 233.

According to some aspects, the second tab 230 may be configured to be situated between the third carton panel 206 and the third drawer panel 306 when the third drawer panel 306 is adjacent to the second tab fold-line 234. Similarly, the third tab 231 may be configured to be situated between the fourth carton panel 208 and the fourth drawer panel 308 when the fourth drawer panel 308 is adjacent to the third tab fold-line 235. See, e.g., FIGS. 10B and 10C.

According to some aspects, a sliding motion (e.g., a translation along a longitudinal axis, a translation along the y-axis) of the drawer 300 past the second tab fold-line 234 from a first end of the carton 200 that is proximal to the first carton panel 202 (e.g., at a top of the carton 200) toward a second end of the carton 200 that is distal to the first carton panel 202 (e.g., at a bottom of the carton 200) may be resisted by the second tab 230. Similarly, a sliding motion (e.g., a translation along a longitudinal axis, a translation along the y-axis) of the drawer 300 past the third tab fold-line 235 from a first end of the carton 200 that is proximal to the first carton panel 202 (e.g., at a top of the carton 200) toward a second end of the carton 200 that is distal to the first carton panel 202 (e.g., at a bottom of the carton 200) may be resisted by the third tab 231.

According to some aspects, the second tab 230 resists the sliding motion of the drawer 300 by having: a first orientation that is substantially parallel the second drawer panel 304 when the second drawer panel 304 is adjacent to the second tab fold-line 234, and a subsequent second orientation that is parallel to and between the third carton panel 206 and the third drawer panel 306 when the third drawer panel 306 is adjacent to the second tab fold-line 234. Similarly, the third tab 231 resists the sliding motion of the drawer 300 by having: a first orientation that is substantially parallel the second drawer panel 304 when the second drawer panel 304 is adjacent to the third tab fold-line 235, and a subsequent second orientation that is parallel to and between the fourth carton panel 208 and the fourth drawer panel 308 when the fourth drawer panel 308 is adjacent to the third tab fold-line 235. It is noted that the second tab fold-line 234 and the third tab fold-line 235 may be spaced apart from the first carton panel 202 by equal distances or may be spaced apart from the first carton panel 202 by unequal distances.

According to some aspects, the second tab 230 may resist the sliding motion of the drawer 300 by resisting an urging of the drawer 300 by the object (e.g., the middle finger of the child) inserted into the carton 200 past the first tab edge 226 of the first carton panel 202 (e.g., insertion through the first carton panel 202). Similarly, the third tab 231 may resist the sliding motion of the drawer 300 by resisting an urging of the drawer 300 by the object (e.g., the middle finger of the child) inserted into the carton 200 past the first tab edge 226 of the first carton panel 202 (e.g., insertion through the first carton panel 202).

According to some aspects, the second tab 230 may resist the sliding motion of the drawer 300 past the second tab 230 when the drawer 300 is urged toward the mouth 504 of the carton 200 by a gravitational force, a centrifugal force, a shaking force, or any combination of two or more of the gravitational force, the centrifugal force, and the shaking force. Similarly, the third tab 231 may resist the sliding motion of the drawer 300 past the third tab 231 when the drawer 300 is urged toward the mouth 504 of the carton 200 by a gravitational force, a centrifugal force, a shaking force, or any combination of two or more of the gravitational force, the centrifugal force, and the shaking force.

The package system may further include a bulkhead panel 242. The bulkhead panel 242 may be spaced apart from and opposing the first carton panel 202 and positioned between the first carton panel 202 and the first drawer panel 302 when the drawer 300 is slidingly engaged with the carton 200. The bulkhead panel 242 may include an aperture 244, defined by interior edges of the bulkhead panel 242, the aperture 244 may be substantially aligned with and may have substantially a same size as the first tab 224.

According to some aspects, the carton 200 may be manufactured as a one-piece cut blank and the bulkhead panel 242 is spaced apart from the first carton panel 202 by space reservation panel 240 that is an integral piece of the one-piece cut blank.

According to some aspects, the bulkhead panel 242 may be spaced apart from the first carton panel 202 by a distance that is equal to or greater than a width ($W_{TE}$) (also referred to as a first-tab-width) of the first tab 224, and the width ($W_{TE}$) of the first tab may be measured perpendicularly to a first tab fold-line 228, between the first tab fold-line 228 and a point on the first tab edge 226 that is distal to the first tab fold-line 228.

According to some aspects, the package system may be designed in view of the following formula: $L_C \geq L_S + L_D$.

Cut Material

FIG. 2 is a line drawing of a first plurality of panels that may together form the carton of FIG. 1. The line drawing of FIG. 2 may be used, for example, to create a die, to guide a laser or some other cutting device, or to guide a folding device. In addition to the first carton panel 202, the second carton panel 204, the third carton panel 206, and the fourth carton panel 208 (all as previously described), the plurality of carton panels may further include a fifth carton panel 210, a sixth carton panel 212, a right bottom sealing panel 214, a left bottom sealing panel 216, a center bottom sealing panel 218, and a front sealing panel 220. When the carton 200 is folded into a carton-shape (as depicted in the exemplary illustration of FIG. 1) the plurality of carton panels separates an interior 502 of the carton 200 from an exterior of the carton 200.

According to one aspect, the second carton panel 204 may be configured to open and close (e.g. uncover and cover) a mouth 504 of the carton 200. When folded into a carton-shape, and using FIG. 5 for exemplary and non-limiting purposes, the mouth 504 of the carton 200 may be defined at least by edges 206*e*, 208*e*, 210*e*, and 212*e*, of third carton panel 206, fourth carton panel 208, fifth carton panel 210, and sixth carton panel 212, respectively. When folded into the carton 200 shape, using FIG. 5 for exemplary and non-limiting purposes, edge 212*e* of the sixth carton panel 212 and edge 220*e* of the front sealing panel 220 may define a single edge. Although depicted as a rectangle in the exemplary figures contained herein, the mouth 504 of the carton 200 may be any shape and may occupy a one-dimensional plane or a multi-dimensional plane.

Adhesive (not shown) may be applied to one or more of the panels to maintain the carton 200 shape during and after manufacture. For example, and without limitation, adhesive may be applied to front sealing panel 220 and/or sixth carton panel 212.

As described above, the carton 200 may further include the second tab 230 (that may be referred to as the tamper-resistant second tab 230) in the third carton panel 206. The carton 200 may still further include, in addition to or instead of the second tab 230, a third tab 231 (that may be referred to as the tamper-resistant third tab 231) in the fourth carton panel 208. The second tab 230 may be defined by a second tab edge 232 (e.g., a straight line, a curved line, a C-shaped line, a U-shaped line) that demarcate at least one edge of the second tab 230 and a second tab fold-line 234 that demarcates at least one other edge of the second tab 230. Similarly, the third tab 231 may be defined by a third tab edge 233 (e.g., a straight line, a curved line, a C-shaped line, a U-shaped line) that demarcate at least one edge of the third tab 231 and a third tab fold-line 235 that demarcates at least one other edge of the third tab 231. The second tab 230, second tab edge 232, and second tab fold-line 234 were described above in connection with FIG. 1. The description will not be repeated here for the sake of brevity and to avoid repetition. The third tab 231, with its third tab edge 233 and third tab fold-line 235 has the same or similar description as the second tab 230 with its corresponding second tab edge 232 and second tab fold-line 234, which again will not be described for the sake of brevity and to avoid repletion.

As described above, the carton 200 may further include the first tab 224 (that may be referred to as the tamper-evident first tab 224) in the first carton panel 202. The first tab 224 may be defined by a first tab edge 226 (e.g., a first row of perforations or the material between the first row of perforation) that demarcate at least one edge of the first tab 224 and a first tab fold-line 228 that demarcates at least one other edge of the first tab 224. The first tab 224, the first tab edge 226 and the first tab fold-line 228 were described above in connection with FIG. 1. The description will not be repeated here for the sake of brevity and to avoid repetition.

According to some aspects, as exemplified by the die line drawing of FIG. 2, the carton 200 may still further include a space reservation panel 240 and a bulkhead panel 242 (which may be integral to the first one-piece cut material). The bulkhead panel 242 may be spaced apart from and opposing the first carton panel 202 (when the carton 200 is folded according to its design). The bulkhead panel 242 may include an aperture 244 defined by interior edges of the bulkhead panel 242. The aperture 244 may be substantially aligned with and may have substantially the same size as the first tab 224 of the first carton panel 202. According to some aspects, the aperture 244 may be substantially the same shape as the first tab 224 of the first carton panel 202. For example, in the die line drawing of FIG. 2, the aperture 244 has a circular edge and the first tab 224 is exemplified by a substantially circular (e.g., frustro-circular) edge. However, the shapes of the aperture 244 and first tab 224 need not have the same or substantially similar shapes. For example, the aperture 244 may be square or rectangular while the first tab 224 is substantially circular (e.g., frustro-circular) or vice versa without departing from the scope of the disclosure.

As exemplified in the illustration of FIG. 2, the space reservation panel 240 may have a space reservation panel length ($L_{SRP}$), (as measured along the y-axis) that is equal to or greater than a width ($W_{TE}$) (also referred to as a first-tab-width) as measured along the x-axis of the first tab 224. According to such an aspect, the bulkhead panel 242 may be spaced apart from the first carton panel 202 by a distance equal to or greater than the width ($W_{TE}$) (also referred to as a first-tab-width) of the first tab 224 of the first carton panel 202 (e.g., as exemplified in FIG. 2, the first-tab-width $W_{TE}$ of the first tab 224 is equal to or less than the space reservation panel length ($L_{SRP}$) of the space reservation panel 240). This spacing may facilitate a rotation of the first tab 224 about the first tab fold-line 228 (e.g., the hinge) such that an edge of the first tab 224 does not substantially interfere with (e.g., substantially contact) the bulkhead panel 242 when the first tab 224 is rotated about the first tab fold-line 228 by 90 degrees, or for example by 90±10 degrees (where rotation is inward toward the bulkhead panel 242). However, it is within the scope of the disclosure for the edge of the first tab 224 to interfere with the bulkhead panel 242 when the first tab 224 is rotated about the first tab fold-line 228 by about 90 degrees. In such a case, the space reservation panel length ($L_{SRP}$) of the space reservation panel 240 may be less than the ($W_{TE}$) (also referred to as the first-tab-width) of the first tab 224. In other words, inclusion of the bulkhead panel 242, spaced apart from and opposing the first carton panel 202 by the space reservation panel length ($L_{SRP}$) of the space reservation panel 240, reserves space between the first carton panel 202 and the bulkhead panel 242 to facilitate inward deflection of the first tab 224 and rotation of the first tab 224 about the first tab fold-line 228 (e.g., the hinge) with minimal if any contact between the first tab 224 and the bulkhead panel 242. In still other words, inclusion of the bulkhead panel 242, spaced apart from and opposing the first carton panel 202 by the apace reservation panel length ($L_{SRP}$) of the space reservation panel 240, reserves space between the first carton panel 202 and the first drawer panel 302 to facilitate inward deflection of the first tab 224 and rotation of the first tab 224 about the first tab fold-line 228 (e.g., the hinge) with minimal if any contact between the first tab 224 and the first drawer panel 302.

According to some aspects, as exemplified by the die line drawing of FIG. 2, the carton 200 may still further include a right top sealing panel 246, a left top sealing panel 248, and a center top sealing panel 250. In an aspect where the carton 200 does not include a space reservation panel 240 and an bulkhead panel 242 that are integral with the other panels (not illustrated herein), the center-top-sealing-panel-fold-line 252 would adjoin the first-carton-panel-fold-line 254. In an aspect where the carton 200 does include the space reservation panel 240 and bulkhead panel 242 that are integral to the other panels (as exemplified in the illustrations herein), the center-top-sealing-panel-fold-line 252 adjoins the bulkhead panel 242 as illustrated in FIG. 2.

FIG. 3 is a line drawing of a second plurality of panels that may together form the drawer 300 of FIG. 1. The line drawing of FIG. 3 may be used, for example, to create a die, to guide a laser or some other cutting device, or to guide a folding device. A drawer 300, like the drawer 300 illustrated herein, may be a box-shaped storage compartment, typically but not necessarily without a lid, made to slide in and out of a thing, such as the carton 200 illustrated herein. In addition to the first drawer panel 302, the second drawer panel 304, the third drawer panel 306, and the fourth drawer panel 308 (all as previously described), the plurality of drawer panels may also include a rear drawer panel 310 ("rear" may be referred to as "floor" herein) and a front drawer panel 312 ("front" may be referred to as "lid" herein). As shown in FIG. 3, the front drawer panel 312 may be subdivided into various sub-panels, including, but not limited to, a front bottom panel $\mathbf{312}_{FB}$, a front bottom vertical panel $\mathbf{312}_{HBV}$, a front bottom recess panel $\mathbf{312}_{FBR}$, a front top panel $\mathbf{312}_{FT}$, a front top vertical panel $\mathbf{312}_{FTV}$, and a front top recess panel $\mathbf{312}_{FTR}$. Other subdivisions, or lack of subdivisions, are within the scope of the disclosure. For example, in an aspect where the front drawer panel 312 is not subdivided, the front drawer panel 312 may serve as a solid lid that covers the contents held within a storage space of the drawer 300 (e.g., a drawer storage space).

The plurality of drawer 300 panels may further include a right bottom drawer sealing panel 314, a left bottom drawer sealing panel 316, a first center bottom drawer sealing panel 318, a second center bottom drawer sealing panel 320, a right top drawer sealing panel 322, a left top drawer sealing panel 324, a first center top drawer sealing panel 326, a second center top drawer sealing panel 328, and a left drawer sealing panel 330.

When the drawer 300 is folded into a drawer-shape (as depicted in the exemplary illustration of FIG. 1) the plurality of drawer panels separates a drawer storage space within the drawer 300 (or at least within five sides of the drawer 300 and a plane coincident with a top of the drawer 300) from a space outside of the drawer 300.

Adhesive may be applied to any one or more of the panels described herein, such as the right bottom sealing panel 214, the left bottom sealing panel 216, the center bottom sealing panel 218, and/or the front sealing panel 220 of FIG. 2, as well as the right bottom drawer sealing panel 314, the left bottom drawer sealing panel 316, the first center bottom drawer sealing panel 318, the second center bottom drawer sealing panel 320, the right top drawer sealing panel 322, the left top drawer sealing panel 324, the first center top drawer sealing panel 326, the second center top drawer sealing panel 328, and/or the left drawer sealing panel 330 of FIG. 3.

Representative Descriptions and Depictions of a Package System

In the following representative descriptions and depictions of a package system 100 as illustrated in FIGS. 4-10, the first tab 224 will be referred to as the tamper-evident first tab 224, the second tab 230 will be referred to as the tamper-resistant second tab 230, and the third tab 231 will be referred to as the tamper-resistant third tab 231. The representative descriptions and depictions and tab names are provided for exemplary and non-limiting reasons.

FIG. 4 is an isometric right-front-top view of the package system 100 of FIG. 1, where the drawer 300 is depicted as sliding into the carton 200, in accordance with aspects described herein. As described in FIG. 1, and summarized here briefly to avoid repetition, FIG. 4, depicts the sliding engagement of the drawer 300 with the interior 502 of the carton 200. The drawer 300 is depicted as sliding into a mouth 504 of the carton 200 along the y-axis, moving into the carton 200 from the bottom end of the carton 200 that is distal to the first carton panel 202, toward the top end of the carton 200 that is proximal to the first carton panel 202. The tamper-evident first tab 224 is intact; the material between the perforations in the first tab edge 226 is not torn and is maintaining the tamper-evident first tab 224 in the plane of the first carton panel 202. When folded into a carton-shape, and using FIG. 5 for exemplary and non-limiting purposes, the mouth 504 of the carton 200 may be defined at least by edges 206*e*, 208*e*, 210*e*, and 212*e*, of third carton panel 206, fourth carton panel 208, fifth carton panel 210, and sixth carton panel 212, respectively. When folded into the carton 200 shape, using FIG. 5 for exemplary and non-limiting purposes, edge 212*e* of the sixth carton panel 212 and edge 220*e* of the front sealing panel 220 may define a single edge. Although depicted as a rectangle in the exemplary figures contained herein, the mouth 504 of the carton 200 may be any shape and may occupy a one-dimensional plane or a multi-dimensional plane.

Likewise, the tamper-resistant second tab 230 is intact; the material between the perforations in the second tab edge 232 is not torn and is maintaining the tamper-resistant second tab 230 in the plane of the third carton panel 206. The tamper-resistant second tab 230 is not deflected into the carton 200.

In accordance with the aspect illustrated in FIG. 4, the tamper-resistant second tab 230 may be maintained in a non-deflected state as the drawer 300 is slid into the carton 200. In accordance with the aspect illustrated in FIG. 5, the tamper-resistant second tab 230 may be deflected into the carton 200 after the drawer 300 is inserted into the carton 200 and the second drawer panel 304 passes the topmost edge of the third tab edge 233 (and topmost edge of the second tab edge 232 (not visible in FIG. 5)). In accordance with another aspect, not illustrated, the tamper-resistant second tab 230 could be deflected inward when the carton 200 is, for example, empty, or in any case before the drawer 300 blocks the inward deflection of the tamper-resistant second tab 230; however, the passage of the drawer 300 into the carton 200 after the tamper-resistant second tab 230 was deflected into the carton 200 would cause the top of the drawer 300 (e.g., first drawer panel 302) to rotate the tamper-resistant second tab 230 about the second tab fold-line 234 (e.g., about the hinge) and force the tamper-resistant second tab 230 back out toward or into the plane of the third carton panel 206, whereupon the tamper-resistant second tab 230 would need to be, once again, deflected into the carton 200 after the drawer 300 was seated in the carton 200 and second drawer panel 304 had passed the topmost edge of the second tab edge 232 and or third tab edge 233 of the tamper-resistant second tab 230 and/or tamper-resistant third tab 231, respectively. While this would involve extra steps in a method of manufacturing a package system according to aspects described herein, an operational or ultimate goal of, for example, having the drawer 300 seated in the carton 200 with the tamper-resistant second tab 230 deflected into the carton 200 could be met. Accordingly, this aspect is also within the scope of the disclosure.

FIG. 5 is a bottom-left-front isotropic view of the package system 100 of FIG. 1, where the drawer 300 is slidingly engaged with the carton 200 and is positioned proximal to the first carton panel 202 (not visible in FIG. 5) (e.g., positioned proximal to the top of the carton 200). On the left-hand side, the second drawer panel 304 (the bottommost panel of the drawer 300) is depicted as having cleared (e.g., moved past, slid past), on the left-hand side, the topmost edge of the third tab edge 233 (e.g., the edge proximal to the first carton panel 202) of the tamper-resistant third tab 231 (not visible in FIG. 5, see FIG. 2). The third tab fold-line 235 (of the tamper-resistant third tab 231) is visible in the illustration of FIG. 5. On the right-hand side, the topmost edge of the second tab edge 232 (e.g., the edge proximal to the first carton panel 202) (not visible in FIG. 5, see FIG. 2) of the tamper-resistant second tab 230. The second tab fold-line 234 (of the tamper-resistant second tab 230) is visible in the illustration of FIG. 5.

The second carton panel 204 and center bottom sealing panel 218 adjoined thereto, as well as the right bottom sealing panel 214 and left bottom sealing panel 216, are illustrated in an open state (e.g., an open position). The open state may be a state that facilitates passage of the drawer 300 into or out of the carton 200 (e.g., into or out of the interior 502 of the carton 200) through the mouth 504 of the carton 200. When folded into a carton-shape, and using FIG. 5 for exemplary and non-limiting purposes, the mouth 504 of the carton 200 may be defined at least by edges 206*e*, 208*e*, 210*e*, and 212*e*, of third carton panel 206, fourth carton panel 208, fifth carton panel 210, and sixth carton panel 212, respectively. When folded into the carton 200 shape, using FIG. 5 for exemplary and non-limiting purposes, edge 212*e* of the sixth carton panel 212 and edge 220*e* of the front sealing panel 220 may define a single edge.

Figure 6A:
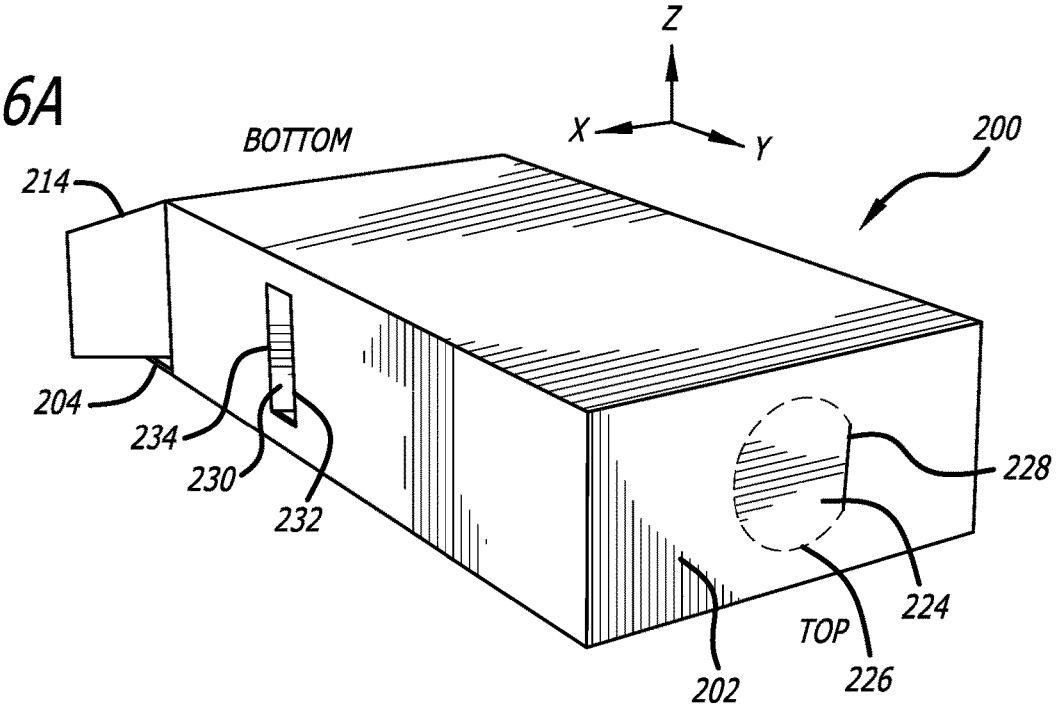
FIG. 6A is a top-right-front isotropic view of the package system as depicted in the FIG. 5, where the drawer (not visible in FIG. 6A) is slidingly engaged with the carton and is positioned proximal to the first carton panel within the carton.
Figure 6B:
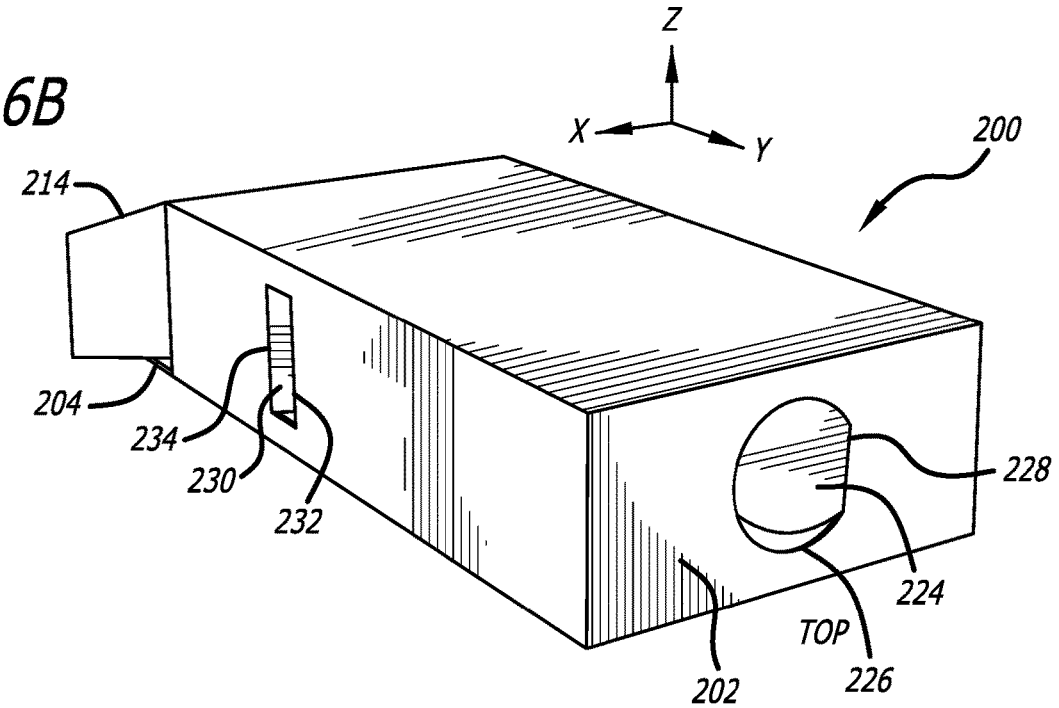
FIG. 6B is a top-right-front isotropic view of the package system as depicted in the FIG. 5, where the drawer (not visible in FIG. 6B) is slidingly engaged with the carton and is positioned proximal to the first carton panel within the carton.

FIG. 6A is a top-right-front isotropic view of the package system 100 as depicted in the FIG. 5, where the drawer 300 (not visible in FIG. 6A) is slidingly engaged with the carton 200 and is positioned proximal to the first carton panel 202 (e.g., positioned proximal to the top of the carton 200) within the carton 200. In FIG. 6A, the tamper-resistant second tab 230 is depicted in an inwardly deflected state and the tamper-evident first tab 224 is intact. FIG. 6B is a top-right-front isotropic view of the package system 100 as depicted in the FIG. 5, where the drawer 300 (not visible in FIG. 6B) is slidingly engaged with the carton 200 and is positioned proximal to the first carton panel 202 (e.g., positioned proximal to the top of the carton 200) within the carton 200. In FIG. 6B, the tamper-resistant second tab 230 is depicted in an inwardly deflected state and the tamper-evident first tab 224 is also depicted in an inwardly deflected state.

On the right-hand side, the tamper-resistant second tab 230 is depicted in an inwardly deflected state. The second tab edge 232 is shown in solid line form to represent that the material between the perforations in the second tab edge 232 has been torn along the second tab edge 232 to facilitate the inward deflection of the tamper-resistant second tab 230. The second tab fold-line 234 (of the tamper-resistant second tab 230) is visible in the illustration of FIG. 6. According to some aspects, a tamper-resistant third tab 231 (not visible in FIG. 6A) may be present on the left-side of the carton 200. The tamper-resistant third tab 231 may also be in an inwardly deflected state, similar to that to of tamper-resistant second tab 230.

The second carton panel 204 as well as the right bottom sealing panel 214, are illustrated in an open state. As used herein, an open state of the second carton panel 204 may be a state of the second carton panel 204 that facilitates passage of the drawer 300 into or out of the carton 200 (e.g., into or out of the interior 502 of the carton 200) through the mouth 504 of the carton 200. The left bottom sealing panel 216 (not visible in FIG. 6A, would likewise be in an open state. The open state is consistent with a carton 200 that has slidingly received a drawer 300 prior to sealing the carton 200 (e.g., prior to placing the second carton panel 204 as well as the right bottom sealing panel 214 and left bottom sealing panel 216 in a closed state). The open state is also consistent with the carton 200 that has had the tamper-evident first tab 224 deflected inward by an object inserted through the first carton panel 202 at a start of a process that will culminate in the drawer 300 being urged (e.g., pushed, forced, compelled) from the interior 502 of the carton 200 toward and through the mouth 504 of the carton 200, after unsealing the carton 200 (e.g., after placing the second carton panel 204 as well as the right bottom sealing panel 214 and left bottom sealing panel 216 in an open state).

In the illustration of FIG. 6A, the tamper-evident first tab 224 is intact; the material between the perforations in the first tab edge 226 is not torn and is maintaining the tamper-evident first tab 224 in the plane of the first carton panel 202. A tamper-evident first tab 224 in an intact state provides evidence that no attempt has been made to urge (e.g., push, force, compel) the drawer 300 (not visible in FIG. 6A) out of the carton 200, and therefore provides evidence that the contents of the drawer 300 (e.g., a product located within) has not been withdrawn from the carton 200 and tampered with (subsequent to having been originally sealed in the carton 200). In the illustration of FIG. 6B, however, the tamper-evident first tab 224 is in an inwardly deflected state; the material between the perforations in the first tab edge 226 is torn and no longer maintains the tamper-evident first tab 224 in the plane of the first carton panel 202. A tamper-evident first tab 224 in an inwardly deflected state (or an outwardly deflected state) provides evidence that an attempt has been made to urge (e.g., push, force, compel) the drawer 300 (not visible in FIG. 6A) out of the carton 200, and therefore provides evidence (or at least provides a warning) that the contents of the drawer 300 (e.g., a product located within) has been withdrawn from the carton 200 and tampered with (subsequent to having been originally sealed in the carton 200).

The tamper-evident first tab 224, the first tab edge 226, and the first tab fold-line 228 were described above in connection with FIG. 1. The description will not be repeated here for the sake of brevity and to avoid repetition.

Figure 7:
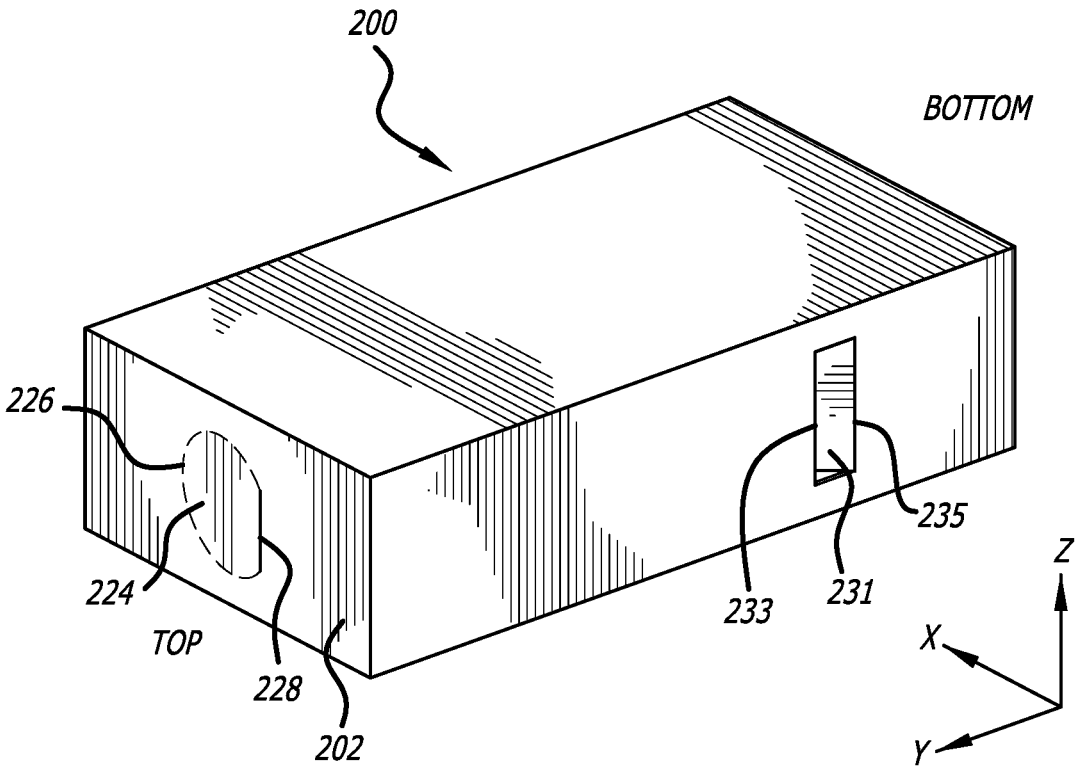
FIG. 7 is a top-left-front isotropic view of the package system as depicted in the FIG. 5 and FIG. 6A, where the drawer (not visible in FIG. 7) is slidingly engaged with the carton and is positioned proximal to the first carton panel.

FIG. 7 is a top-left-front isotropic view of the package system 100 as depicted in the FIG. 5 and FIG. 6A, where the drawer 300 (not visible in FIG. 7) is slidingly engaged with the carton 200 and is positioned proximal to the first carton panel 202 (e.g., positioned proximal to the top of the carton 200).

On the left-hand side, the tamper-resistant third tab 231 is depicted in an inwardly deflected state. The third tab edge 233 is shown in solid line form to represent that the material between the perforations in the third row of perforations has been torn along the third tab edge 233 to facilitate the inward deflection of the tamper-resistant third tab 231. The third tab fold-line 235 (of the tamper-resistant third tab 231) is visible in the illustration of FIG. 7.

In the illustration of FIG. 7, the second carton panel 204 and center bottom sealing panel 218 (neither visible in FIG. 7) as well as the right bottom sealing panel 214 and left bottom sealing panel 216 (neither visible in FIG. 7), are illustrated in a closed state (e.g., a state that blocks passage of the drawer 300 (not visible in FIG. 7) into or out of the interior 502 of the carton 200 through the mouth 504 of the carton 200.

In the illustration of FIG. 7, the tamper-evident first tab 224 is intact; the material between the perforations in the first tab edge 226 is not torn and is maintaining the tamper-evident first tab 224 in the plane of the first carton panel 202. The tamper-evident first tab 224, the first tab edge 226, and the first tab fold-line 228 were described above in connection with FIG. 1. The description will not be repeated here for the sake of brevity and to avoid repetition.

Figure 8:
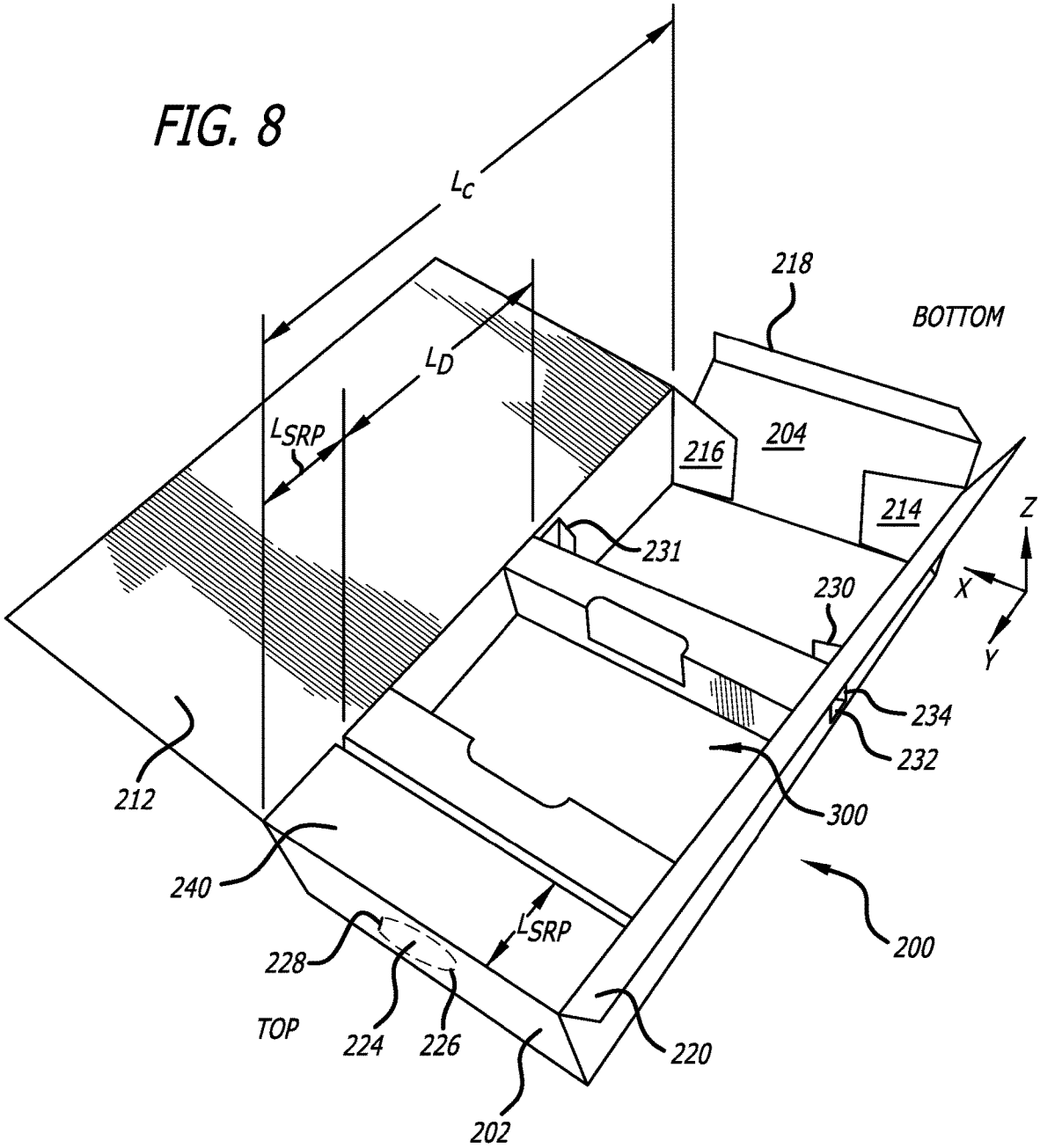
FIG. 8 is a top-left-front isotropic view of a package system, similar to the package system as described and depicted in FIG. 5, FIG. 6A, and FIG. 7, where the drawer is slidingly engaged with the carton and is positioned proximal to the first carton panel (e.g., positioned proximal to the top of the carton). The sixth carton panel and the front sealing panel (or vice versa) are folded open to allow observation of the drawer within an interior of the carton.

FIG. 8 is a top-left-front isotropic view of a package system 100, similar to the package system 100 as depicted in FIGS. 5, 6A, and 7, where the drawer 300 is slidingly engaged with the carton 200 and is positioned proximal to the first carton panel 202 (e.g., positioned proximal to the top of the carton 200). The sixth carton panel 212 (e.g., the lid) and the front sealing panel 220 are folded open to allow observation of the drawer 300 within the interior 502 of the carton 200. In an operational state, the sixth carton panel 212 may be sealed to the front sealing panel 220 (or vice versa) to deny access to the interior 502 of the carton 200.

On the right-hand side, the tamper-resistant second tab 230 is depicted in an inwardly deflected state. Lead lines and reference numbers related to the second tab edge 232 and second tab fold-line 234 are omitted to avoid cluttering the drawing. On the left-hand side, the tamper-resistant third tab 231 is depicted in an inwardly deflected state. The third tab edge 233 is shown in solid line form to represent that the material between the perforations in the third tab edge 233 has been torn along the third tab edge 233 to facilitate the inward deflection of the tamper-resistant third tab 231. The third tab fold-line 235 (of the tamper-resistant third tab 231) is visible in the illustration of FIG. 8.

In the illustration of FIG. 8, the second carton panel 204 and center bottom sealing panel 218 adjoined thereto as well as the right bottom sealing panel 214 and left bottom sealing panel 216 are illustrated in an open state. For purposes of illustration, the sixth carton panel 212 and front sealing panel 220 are folded open to allow observation of the drawer 300 within the interior 502 of the carton 200. In an operational configuration, the sixth carton panel 212 and front sealing panel 220 would be closed and may be sealed, for example, by application of adhesive to one or both of the sixth carton panel 212 and front sealing panel 220 across at least some of the surfaces that project upon each other.

In the illustration of FIG. 8, the tamper-evident first tab 224 is intact; the material between the perforations in the first tab edge 226 is not torn and is maintaining the tamper-evident first tab 224 in the plane of the first carton panel 202. The tamper-evident first tab 224, the first tab edge 226, and the first tab fold-line 228 were described above in connection with FIG. 1. The description will not be repeated here for the sake of brevity and to avoid repetition.

As previously described, the carton length ($L_C$) of the carton 200 may be defined by a first distance between the first carton panel 202 and the second carton panel 204 (after the carton 200 is fully folded and the first carton panel 202 and the second carton panel 204 are closed according to their design). As previously described, the drawer length ($L_D$) of the drawer 300 may be defined by a second distance between the first drawer panel 302 and the second drawer panel 304 (when the drawer 300 is folded according to its design). Lead lines and reference numbers of the first drawer panel 302 and the second drawer panel 304 are omitted from FIG. 8 to avoid cluttering the drawings. According to one aspect, the carton length ($L_C$) of the carton 200 may be equal to or greater than the drawer length ($L_D$) of the drawer 300 plus an average length of a middle finger of a child 7.5 years old or younger, without regard to the presence or absence of the space reservation panel 240 and/or the space reservation panel length ($L_{SRP}$) of the space reservation panel 240. According to another aspect, the carton length ($L_C$), may be equal to or greater than the drawer length ($L_D$) of the drawer 300 plus an average length of a middle finger of a child 7.5 years old or younger and less than an average length of a middle finger of an adult, without regard to the presence or absence of the space reservation panel 240 and/or the space reservation panel length ($L_{SRP}$) of the space reservation panel 240. For exemplary purposes, the average length of a middle finger of a child 7.5 years old and younger is established as 58 mm.

As previously described, in the exemplary figures depicted herein, a space reservation panel 240 may be provided integral with and adjoined to the first carton panel 202. As exemplified in the illustration of FIG. 2 and the illustration of FIG. 8, the space reservation panel 240 may have a space reservation panel length ($L_{SRP}$) (as measured along the y-axis). The space reservation panel 240 may be used to space apart the first carton panel 202 from the first drawer panel 302 by a distance equal to or greater than a width ($W_{TE}$) (also referred to as a first-tab-width) of the tamper-evident first tab 224 of the first carton panel 202. It will be understood that in an aspect not depicted herein, the space reservation panel 240 and bulkhead panel 242 (FIG. 2) may not be present, or, if present, may not be integral to the carton 200 (e.g., not formed from the same piece of cut material as the carton 200). For example, using the illustration of FIG. 8 for reference, the space reservation panel 240 and bulkhead panel 242 may be formed from a separate "L-shaped" or "C-shaped" (e.g., one piece of material folded to include two opposing spaced apart segments that may be at right angles to a center joining segment) material having an aperture (e.g., similar to aperture 244, FIG. 2) that may be inserted into the carton 200 before insertion of the drawer 300 therein. By way of yet another example, using the illustration of FIG. 8 for reference, the space reservation panel 240 and bulkhead panel 242 may be formed from a an elongated four-sided square or rectangular shape separate inserted into the carton 200 before insertion of the drawer 300 therein. In such a configuration, the four-sided square or rectangular shape may have two opposing apertures, to facilitate passage of a finger through both apertures.

Figure 9:
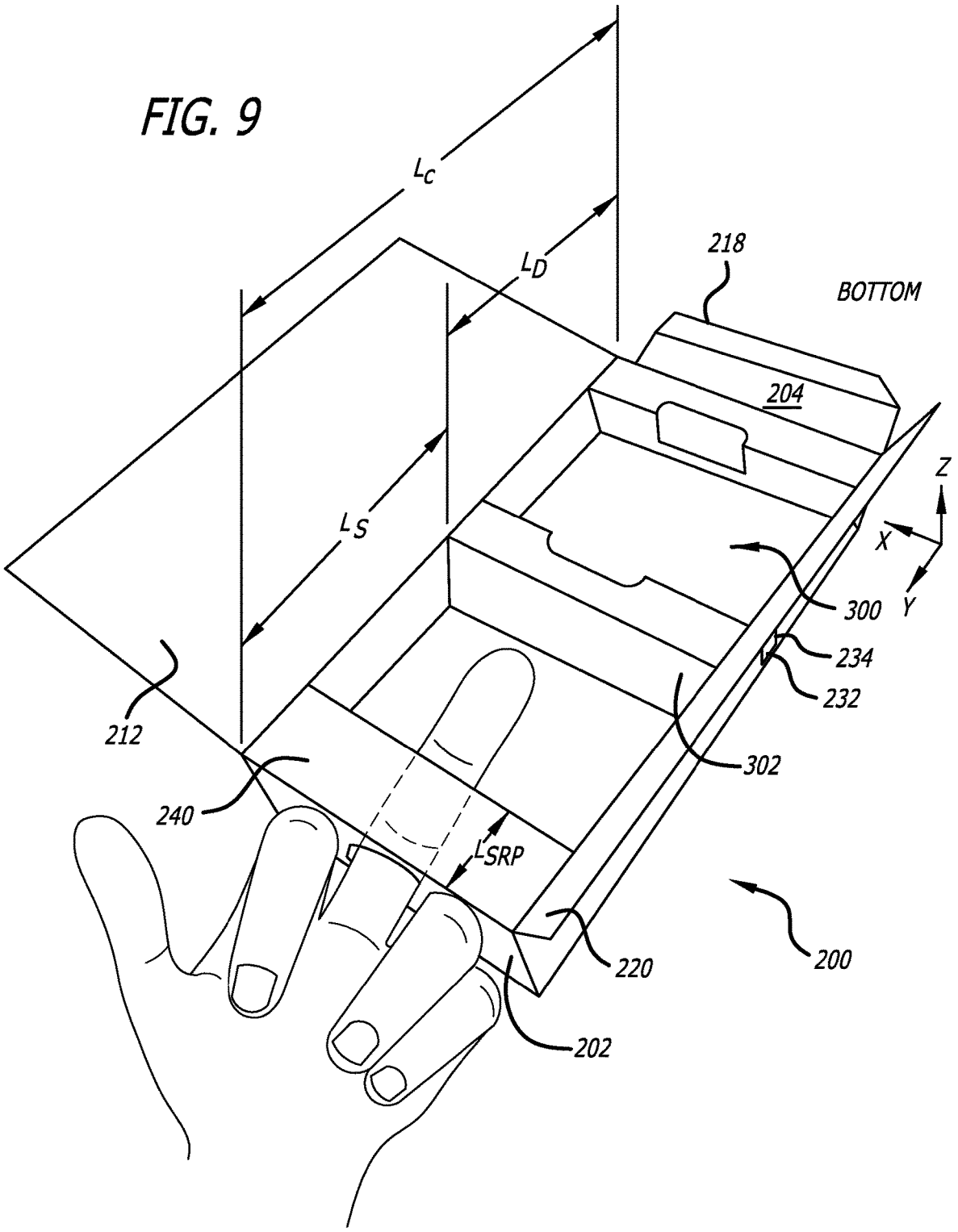
FIG. 9 is a top-left-front isotropic view of the package system of FIG. 8, where the drawer is slidingly engaged with the carton.

FIG. 9 is a top-left-front isotropic view of the package system 100 of FIG. 8, where the drawer 300 is slidingly engaged with the carton 200. However, in contrast to the illustrations of FIGS. 5, 6A, 7, and 8, the drawer 300 in FIG. 9 is positioned distal to the first carton panel 202 (e.g., positioned distal to the top of the carton 200), having been moved toward the bottom of the carton 200 by a finger of a child. The sixth carton panel 212 and the front sealing panel 220 are folded open to allow observation of the drawer 300 within the interior 502 of the carton 200. In an operational state, the sixth carton panel 212 may be sealed to the front sealing panel 220 (or vice versa) to deny access to the interior 502 of the carton 200.

In the illustration of FIG. 9, a child's middle finger has penetrated the tamper-evident first tab 224 and deflected it inward to the carton 200. The child's middle finger has been inserted into the carton 200 (through the aperture defined by the first tab edge 226 and the first tab fold-line 228 of the tamper-evident first tab 224. The child's middle finger has urged (e.g., pushed, forced, compelled) the drawer 300 along a portion of the length of the interior 502 of the carton 200. The force of the child's inserted middle finger has overcome the resistance offered directly by the tamper-evident first tab 224 and indirectly by the tamper-resistant second tab 230 (and/or the tamper-resistant third tab 231).

The resistance of the tamper-resistant second tab 230 (and/or the tamper-resistant third tab 231) has a first resistance point when the drawer 300 folds the tamper-resistant tab(s) flat against the second drawer panel 304, perpendicular to the third carton panel 206 and/or fourth carton panel 208. In this state, initial force used to slide the drawer 300 within the interior 502 of the carton 200 will cease to allow the sliding motion of the drawer 300 toward the mouth 504 of the carton 200. The drawer 300 will stop at this point until additional force is applied to the drawer 300. The additional force may bend the tamper-resistant tab(s) to an angle that is greater than 90 degrees relative to the third carton panel 206 and/or fourth carton panel 208. The additional force, if applied, will cause the tamper-resistant second tab 230 (and/or the tamper-resistant third tab 231) to fold flat against the inner surface of the third carton panel 206 (and/or the fourth carton panel 208), such that the tamper-resistant second tab 230 (and/or the tamper-resistant third tab 231) will be situated substantially parallel to and between the third carton panel 206 and third drawer panel 306 (and/or be situated substantially parallel to and between the fourth carton panel 208 and fourth drawer panel 308). The force may be necessary to further slide the drawer 300 toward and out of the mouth 504 of the carton 200 may be the force necessary to overcome the friction cause by the added thickness of the tamper-resistant second tab 230 (and/or tamper-resistant third tab 231) folded back upon itself (e.g., folded approximately or equal to 180 degrees relative to its initial position or state) in the interior 502 of the carton 200.

As shown in the illustration of FIG. 9, even if the child was able to exert the first force necessary to move the drawer 300 past the 90 degree folded tamper-resistant tab(s) and the second force necessary to continue slidingly moving the drawer 300 past the folded-back (e.g., approximately or equal to 180 degrees relative to its initial position or state) tamper-resistant tab(s), the child still could not urge (e.g., push, force, compel) the drawer 300 out of the mouth 504 of the carton 200 because the length of the child's longest finger (the middle finger) is less than or equal to the length of the carton $L_C$ minus the length of the drawer $L_D$.

Figures 10A, 10B, 10C:
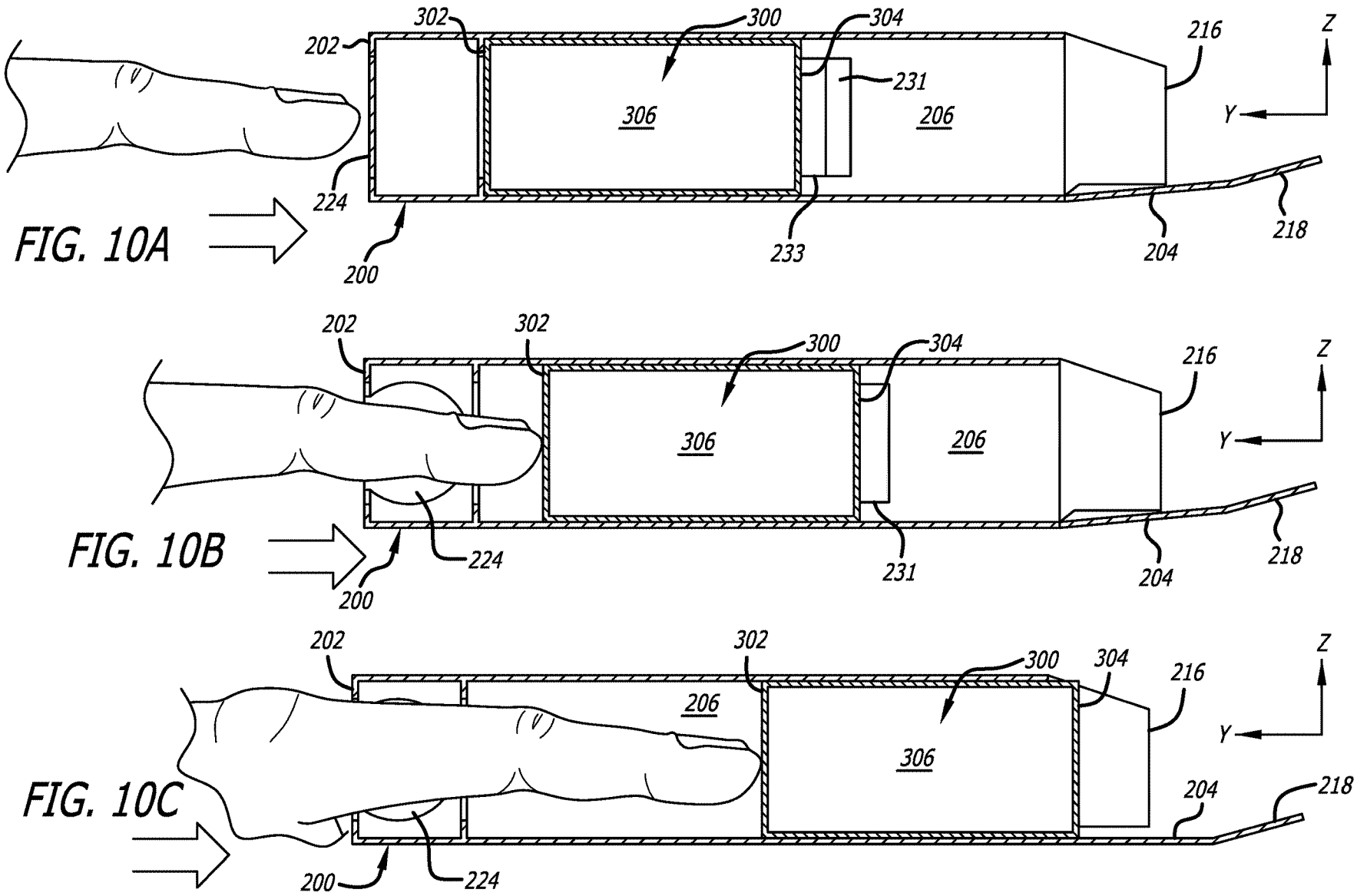
FIG. 10A is a left side cross-section elevation view of the package system as depicted in FIG. 8 and FIG. 9, where the drawer is slidingly engaged with the carton and is positioned proximal to the first carton panel. The second tab is depicted in an inwardly deflected state and the first tab is intact.
FIG. 10B is a left side cross-section elevation view of the package system as depicted in FIG. 10A, where the adult finger has penetrated the first tab, rotating it into the plane of the figure.
FIG. 10C is a left side cross-section elevation view of the package system as depicted in FIG. 10A and FIG. 10B, where the adult finger has penetrated the first tab, and has exerted a force upon the first drawer panel to urge (e.g., push, force, compel) the second drawer panel out from a mouth of the carton.

FIG. 10A is a left side cross-section elevation view of the package system 100 as depicted in the FIG. 8 and FIG. 9, where the drawer 300 is slidingly engaged with carton 200 and is positioned proximal to the first carton panel 202. The second tab 230 is depicted in an inwardly deflected state and the first tab 224 is intact. In other words, the material between the perforations in the first tab edge 226 of the tamper-evident first tab 224 is not torn and is maintaining the tamper-evident first tab 224 in the plane of the first carton panel 202. An adult finger approaches the tamper-evident first tab 224 from the top (left side of drawing) moving downward toward the bottom (right side of drawing), parallel to the y-axis (in the negative y direction). The tamper-resistant second tab 230 is illustrated as being deflected into the carton 200 by about 45 degrees relative to the plane of the third carton panel 206. The second tab edge 232 (shown in solid line form to represent the line of torn material between perforations, is illustrated. The second carton panel 204, center bottom sealing panel 218, and right bottom sealing panel 214, are illustrated in an open state.

FIG. 10B is a left side cross-section elevation view of the package system 100 as depicted in the FIG. 10A, where the adult finger has penetrated the first tab 224, rotating it into the plane of the figure. The adult finger is exerting force upon the first drawer panel 302. The exerted force slides the drawer 300 within the interior 502 of the carton 200, from the top (left side of drawing) toward the bottom (right side of drawing), parallel to the y-axis (in the negative y direction). The tamper-resistant second tab 230 is illustrated as being deflected into the carton 200 by about 180 degrees relative to its original orientation (e.g., position or state) in the plane of the third carton panel 206. In other words, the second drawer panel 304 has contacted the tamper-resistant second tab 230, urged the tamper-resistant second tab 230 to be parallel to the plane of the second drawer panel 304 (e.g., about 90 degrees relative to its original orientation in the plane of the third carton panel 206) (not shown in the illustration) and then moved further to further urge the tamper-resistant second tab 230 to be again parallel to the plane of the third carton panel 206, but 180 degrees from its original orientation (e.g., the tamper-resistant second tab 230 is folded back upon itself). The second carton panel 204, center bottom sealing panel 218, and right bottom sealing panel 214, are illustrated in an open state.

FIG. 10C is a left side cross-section elevation view of the package system 100 as depicted in FIG. 10A and FIG. 10B, where the adult finger has penetrated the first tab 224, and has exerted a force upon the first drawer panel 302 to urge (e.g., push, force, compel) the second drawer panel 304 out from the mouth 504 of the carton 200. The second carton panel 204 and right bottom sealing panel 214 are deflected away from the mouth 504 of the carton 200 by force of the drawer 300. The second carton panel 204, center bottom sealing panel 218, and right bottom sealing panel 214, are illustrated in an open state. In this state, because the length of the adult finger plus length of the drawer ($L_D$) is greater than the length of the carton ($L_C$) the drawer 300 is urge (e.g., pushed, forced, compelled) partially beyond the mouth 504 of the carton 200 and the drawer 300 can be grasped and pulled out from the interior 502 of the carton 200.

Method of Manufacturing a Package System

Figure 11:
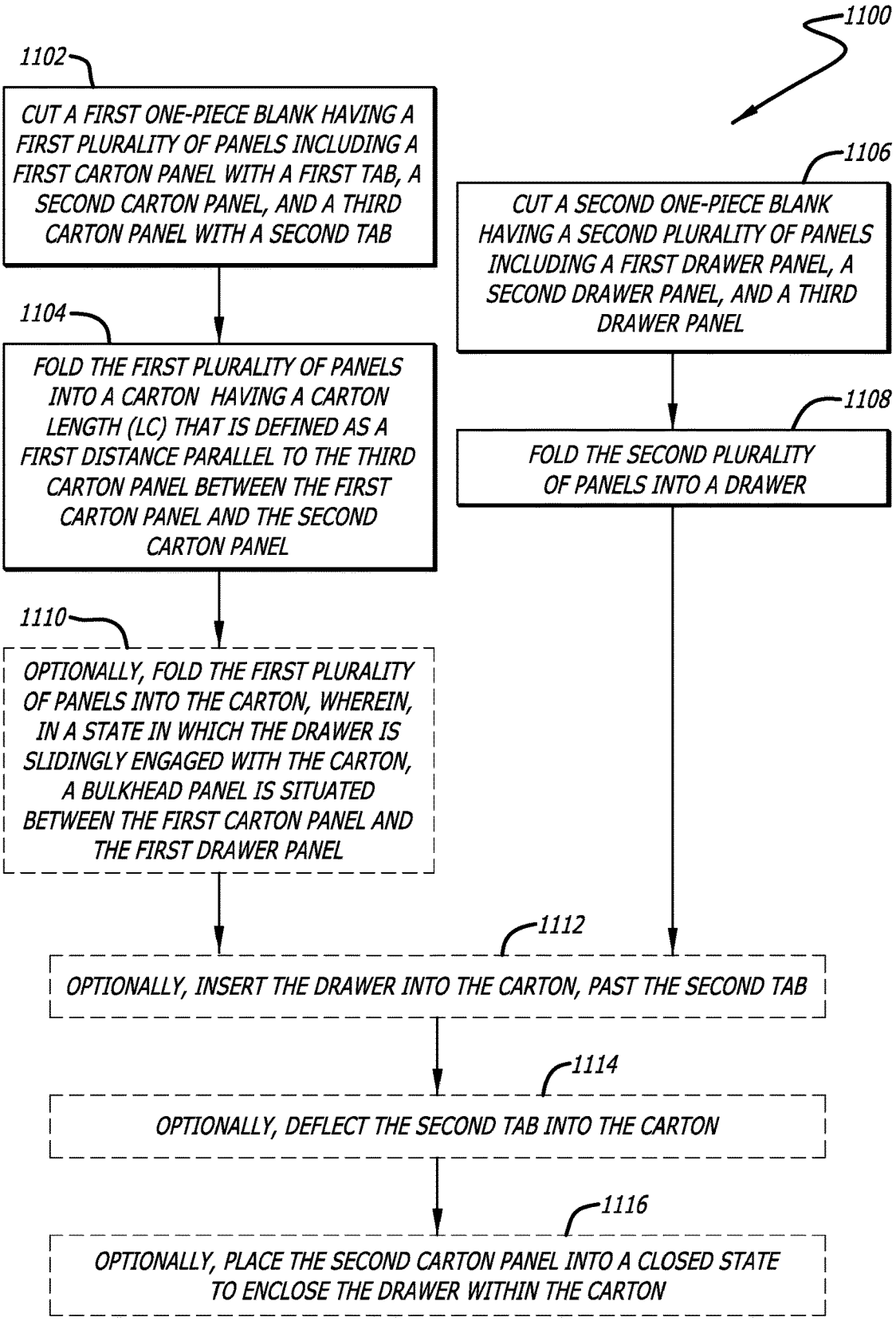
FIG. 11 illustrates a method of manufacturing a package system, such as the package system of FIG. 1 and FIG. 8, in accordance with aspects described herein.

FIG. 11 illustrates a method 1100 of manufacturing a package system, such as the package system 100 of FIG. 1 and FIG. 8, in accordance with aspects described herein. The method 1100 is exemplary and non-limiting. The package system manufactured by the method 1100 may be a tamper-evident, tamper-resistant package system. For exemplary and non-limiting reasons, a first tab 224 may be tamper-evident first tab 224, the second tab 230 may be a tamper-resistant second tab 230, and the third tab 231 may be tamper-resistant third tab 231.

The method 1100 may begin with cutting a first 1102 one-piece blank having a first plurality of panels including a first carton panel 202 with a first tab 224, a second carton panel 204, and a third carton panel 206. The third carton panel may have a second tab 230. The first plurality of panels may all be joined, directly or indirectly, to one another (for example, the collection of all panels in FIG. 2 represents such a first plurality of panels). The panels and tabs are may be the same or similar to those described above in connection with FIGS. 1-10 herein. The cutting may be accomplished by any method known to those of skill in the art including, but not limited to, die-cutting, laser-cutting, punch-press-cutting, or any combination thereof.

The method 1100 may continue with folding 1104 the first plurality of panels into a carton 200 having a carton length ($L_C$) that is defined as a first distance parallel to the third carton panel 206 between the first carton panel 202 and the second carton panel 204. More particularly, the method 1100 may continue with folding 1104 the first plurality of panels into a carton 200 having the first carton panel 202 opposing the second carton panel 204, the third carton panel 206 adjoined between the first carton panel 202 and the second carton panel 204, and the carton 200 having a carton length ($L_C$) that is defined as a first distance parallel to the third carton panel 206 between the first carton panel 202 and the second carton panel 204.

Optionally, the first plurality of panels may further include a fourth carton panel 208 with a third tab 231 spaced apart from and opposing the third carton panel 206 and adjoined between the first carton panel 202 and the second carton panel 204.

Coincident with, before, or after cutting the first 1102 one-piece blank, the method 1100 may further include cutting a second 1106 one-piece blank having a second plurality of panels including a first drawer panel 302, a second drawer panel 304, and a third drawer panel 306. The second plurality of panels may all be joined, directly or indirectly, to one another and may be referred to a second plurality of panels (for example the collection of all panels in FIG. 3 represents such a second plurality of panels). The panels and tabs are may be the same or similar to those described above in connection with FIGS. 1-10 herein. The cutting may be accomplished by any method known to those of skill in the art including, but not limited to, die-cutting, laser-cutting, punch-press-cutting, or any combination thereof.

The method 1100 may further include folding 1108 the second plurality of panels into a drawer 300. More particularly, the method 1100 may further include folding 1108 the second plurality of panels into a drawer 300 having the first drawer panel 302 opposing the second drawer panel 304, the third drawer panel 306 adjoined between the first drawer panel 302 and the second drawer panel 304, and the drawer 300 having a drawer length ($L_D$) that is defined as a second distance parallel to the third drawer panel 306 and between the first drawer panel 302 and the second drawer panel 304. The drawer 300 may be configured to enter into a sliding engagement with the carton 200 and fit within an interior 502 of the carton 200 with the first drawer panel 302 opposing the first carton panel 202, the second drawer panel 304 opposing the second carton panel 204, and the third drawer panel 306 opposing the third carton panel 206.

In a state in which the drawer 300 is slidingly engaged with the carton 200, the second drawer panel 304 may remain within the carton 200 when the first drawer panel 302 is spaced apart from the first carton panel 202 by a safety length (LS) that may be defined as a maximum length of an object that, upon insertion of the object into the carton 200 past a first tab edge 226 of the first tab 224 of the first carton panel 202, causes the second drawer panel 304 to be situated within an interior 502 of the carton 200 and juxtaposed with a plane defined by a mouth 504 of the carton 200 that is proximal to the second carton panel 204. When folded into a carton-shape, and using FIG. 5 for exemplary and non-limiting purposes, the mouth 504 of the carton 200 may be defined at least by edges 206*e*, 208*e*, 210*e*, and 212*e*, of third carton panel 206, fourth carton panel 208, fifth carton panel 210, and sixth carton panel 212, respectively. When folded into the carton 200 shape, using FIG. 5 for exemplary and non-limiting purposes, edge 212*e* of the sixth carton panel 212 and edge 220*e* of the front sealing panel 220 may define a single edge. Although depicted as a rectangle in the exemplary figures contained herein, the mouth 504 of the carton 200 may be any shape and may occupy a one-dimensional plane or a multi-dimensional plane.

According to some aspects the first plurality of panels encloses and defines an interior 504 of the carton 200. According to some aspect, the first plurality of panels includes the first carton panel 202, the second carton panel 204, and the third carton panel 206. According to some aspects, the first plurality of panels includes the first carton panel 202, the second carton panel 204, the third carton panel 206, and a fourth carton panel 208. According to still other aspects, the first plurality of panels includes three or more panels. According to some aspects, when folded into a carton-shape, and using FIG. 5 for exemplary and non-limiting purposes, the mouth 504 of the carton 200 may be defined at least by edges 206*e*, 208*e*, 210*e*, and 212*e*, of third carton panel 206, fourth carton panel 208, fifth carton panel 210, and sixth carton panel 212, respectively. When folded into the carton 200 shape, using FIG. 5 for exemplary and non-limiting purposes, edge 212*e* of the sixth carton panel 212 and edge 220*e* of the front sealing panel 220 may define a single edge.

According to some aspects, the first plurality of panels may further optionally include a bulkhead panel 242 spaced apart from the first carton panel 202 and adjoined to the first carton panel 202 by a space reservation panel 240. The method 1100 of manufacturing the package system 100 may optionally further include folding 1110 the first plurality of panels (including the bulkhead panel 242) into the carton 200 where, in a state in which the drawer 300 is slidingly engaged with the carton 200, the bulkhead panel 242 is situated between the first carton panel 202 and the first drawer panel 302.

According to some aspects, the third carton panel 206 and third drawer panel 306 may be parallel to a longitudinal axis (e.g., a y-axis as illustrated in the figures herein) and the drawer 300 may be configured to translate along the longitudinal axis between the first carton panel 202 and the second carton panel 204. According to some aspects, where the carton 200 includes the bulkhead panel 242, the third carton panel 206 and third drawer panel 306 may be parallel to a longitudinal axis (e.g., a y-axis as illustrated in the figures herein) and the drawer 300 may be configured to translate along the longitudinal axis between the bulkhead panel 242 and the second carton panel 204.

According to some aspects, a carton length ($L_C$), a drawer length ($L_D$), and a safety length ($L_s$) may be defined. The carton length ($L_C$) may be defined as a first distance parallel to the third carton panel 206 and between the first carton panel 202 and the second carton panel 204 The drawer length ($L_D$) may be defined as a second distance parallel to the third drawer panel 306 (or, e.g., the third carton panel 206 if the third carton panel 206 is not parallel to the third drawer panel 306) and between the first drawer panel 302 and the second drawer panel 304. The safety length ($L_S$) may be defined as a maximum length of an object that, upon insertion of the object into the carton 200 past a third tab edge 233 of the third tab 231 of the third carton panel 206, causes the second drawer panel 304 to be situated within an interior 502 of the carton 200 and juxtaposed with a plane defined by the mouth 504 of the carton 200 that is proximal to the second carton panel 204. The object may be inserted into the carton 200 after deflecting the first tab 224 into the carton 200 (e.g., tearing the material between the perforations of the first tab edge 226 and rotating the first tab 224 about the first tab fold-line 228 into the carton 200.

An example of an object so inserted is exemplified by a finger of a child's hand in FIG. 9. The safety length ($L_S$) informs manufacturers, users, and sellers of a maximum length of an object that can be inserted through the first tab 224 of the first carton panel 202 and still keep the second drawer panel 304 of the drawer 300 within the carton 200 (e.g., within the carton 200 and juxtaposed to a plane coincident with the mouth 504 of the carton 200. The safety length ($L_S$) may therefore be used to establish an age of a child below which the carton 200 is safe from tampering. For example, if the safety length ($L_S$) is 58 mm, children of 6.5-7.5 years of age and younger are safe even if left alone with the carton 200, because the middle finger length of such children is 58 mm or less according to Snyder 1977 Child. Accordingly, children of 6.5-7.5 years of age and younger will be unable to push (e.g., urge forward, force forward, compel forward) or pull urge (e.g., urge backward, force backward, compel backward) the drawer 300 from the carton 200 even if they do insert the entire length of their middle finger (the longest finger of a child's hand) completely into the carton 200, through the first tab 224 of the first carton panel 202. According to some aspects, the panels of the carton 200 and drawer 300 may be designed such that $L_C \geq L_S + L_D$.

The method 1100 may optionally continue with inserting 1112 the drawer 300 into the carton 200 (e.g., inserting the drawer 300 into the interior 504 of the carton 200), past the second tab 230. Inserting the drawer 300 into the carton 200 may be achieved by sliding engaging the drawer 300 with the carton 200 at an end of the carton 200 that is distal to the first carton panel 202 and urging (e.g., pushing, forcing, compelling) the drawer 300 toward the first carton panel 202 (or toward the bulkhead panel 242 if present). The drawer 300 may be inserted such that the second drawer panel 304 is past the second tab 230. When a fourth carton panel 208 (or additional) with a third tab 231 is included in the first plurality of panels that make up the carton 200, the drawer 300 may also be inserted such that the second drawer panel 304 is past the third tab 231.

The method 1100 may continue by deflecting 1114 the second tab (or third tab (if present), or both (if present)) into the carton 200 (e.g., into the interior 504 of the carton 200).

The method 1100 may continue by placing 1116 the second carton panel 204 into a closed state to enclose the drawer 300 (and its contents if any) within the carton 200 (e.g., within the interior 504 of the carton 200). The second carton panel 204 may be placed in a closed state by rotating the second carton panel 204 about edge 210*e* (e.g., about the fold-line coincident with edge 210*e*) to a position that is covering the mouth 504 of the carton 200.

According to some aspects, the method 1100 may optionally further include placing a product into the drawer 300 prior to inserting the drawer 300 into the carton 200. Examples of products may include vials or medicine, cartridges filled with toxic and/or poisonous substances, and flavor/nicotine pods for e-cigarettes. The preceding list is exemplary and not limiting.

According to some aspects, the carton 200 manufactured according to the method 1100 may include a fourth carton panel 208 with a third tab 231. The fourth carton panel 208 may be spaced apart from and opposing the third carton panel 206 and adjoined between the first carton panel 202 and the second carton panel 204. The method 1100 may further include folding the second one-piece blank into the drawer 300 having the second plurality of panels. The second plurality of panels may further include a fourth drawer panel 308. The fourth drawer panel may be spaced apart from and opposing the third drawer panel 306 and may be adjoined between the first drawer panel 302 and the second drawer panel 304. The fourth drawer panel 308 opposing the fourth carton panel 208.

Various disclosures contained herein may be described as a method (e.g., a process) that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A method or process is terminated when its operations are completed.

While the foregoing disclosure shows illustrative aspects, it should be noted that various changes and modifications could be made herein without departing from the scope of the disclosure as defined by the appended claims. The functions, steps and/or actions of the method claims in accordance with the aspects described herein need not be performed in any particular order. Furthermore, although elements of aspects disclosed herein may be described or claimed in the singular, the plural is contemplated unless limitation to the singular is explicitly stated.

Aspects described in connection with a given description, illustration, representation, or method may be substituted for aspects described in a different description, illustration, representation, or method.

The construction "A and/or B" is used herein to mean "A and B" or "A" alone, or "B" alone. The construction "A, B, and/or C" is used herein to mean "A and B and C" or "A and B" or "A and C" or "B and C" or "A" alone, or "B" alone, or "C" alone.

The construction "at least one of A and B" encompasses "A" alone, or "B" alone or "A and B." The construction "at least one of A, B, and C" encompasses "A and B and C" or "A and B" or "A and C" or "B and C" or "A" alone, or "B" alone, or "C" alone.

The word "aperture" is used herein to mean an opening defined by one or more continuous or discontinuous interior edges or interior walls of the material in which the aperture is formed.

The word "aspects" does not require that all aspects of the disclosure include the discussed tab, advantage or mode of operation.

The word "coupled" is used herein to refer to the direct or indirect coupling between two objects. For example, if object A physically touches object B, and object B touches object C, then objects A and C may still be considered coupled to one another—even if they do not directly physically touch each other.

The word "exemplary" is used herein to mean "serving as an example, instance, or illustration." Any implementation or aspect described herein as "exemplary" is not necessarily to be construed as preferred or advantageous over other implementations or aspects described herein.

The word "adjacent" is used herein to mean placed close together and/or fitting closely together; where the words "close" and "closely" are used herein to mean nearby, touching or almost touching or nearly touching or barely touching. For example, two panels may be adjacent when they are in direct contact with one another over an entirety of both opposing surface areas, at least some of both opposing surface areas, none of both opposing surface areas but having a slight air gap between them, or in indirect contact with one another (i.e., coupled), such as when an intermediate panel or material is fit between them.

The word "opposing" is used herein to mean facing or opposite to. Opposing panels, for example, may face one another but are not necessarily parallel to one another.

The word "paperboard" is used herein to mean any foldable paper-like material able to hold a crease including, for example, cardboard and pasteboard.

The word "perforate" is used herein to mean the action of making a row of holes in a material (such as paperboard) such that the material can be torn along a length of the row of holes. The word "non-perforated" is used herein to mean material that is not perforated.

The words "perforation" and "perforated line" are used herein to describe a row of holes in a material (each hole defined by wall(s) of material at an edge bordering the hole), which facilitate the tearing of the material along the length of the row. An example of the material may be paperboard. The perforation and perforated line may be any shape, such as a straight line, a curved line, a line bent at any angle, a discontinuous line and a continuous line, such as a line defining a circular or polygonal shape.

The word "tab" is used herein to mean a panel or strip of material attached to a panel that may be deflected into or out of a plane of the panel or may be pulled out from or away from the panel. A tab may be any shape including, but not limited to, polygonal, circular, or a combination thereof.

In one or more exemplary embodiments, the functions described may be implemented in hardware, software, firmware, or any combination thereof. If implemented in software as a computer program product, the functions may be stored on or transmitted over as one or more instructions or code on a computer-readable medium. Computer-readable media includes both non-transitory computer-readable storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed embodiments is provided to enable any person skilled in the art to make or use the aspects described herein. Various modifications to these embodiments will be readily apparent to those skilled in the art, and the generic principles defined herein may be applied to other embodiments without departing from the spirit or scope of the invention. Thus, the disclosure is not intended to be limited to the embodiments shown herein but is to be accorded the widest scope consistent with the principles and novel aspects disclosed herein.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A package system, comprising:

a carton having at least a first carton panel including a first tab having a first tab edge defined by internal walls of the first carton panel, a second carton panel opposing the first carton panel, and a third carton panel adjoined between the first carton panel and the second carton panel, the carton having a carton length ($L_c$) that is defined as a first distance parallel to the third carton panel between the first carton panel and the second carton panel; and a drawer configured to slide into and out of an interior of the carton, the drawer having at least a first drawer panel opposing the first carton panel, a second drawer panel opposing the second carton panel, and a third drawer panel opposing the third carton panel, the third drawer panel adjoined between the first drawer panel and the second drawer panel, the drawer having a drawer length ($L_D$) that is defined as a second distance parallel to the third drawer panel between the first drawer panel and the second drawer panel, a second tab included with the third carton panel and having a second tab edge defined by internal walls of the third carton panel and a second tab fold-line, the second tab folding toward an interior of the carton along the second tab fold-line; and wherein the second drawer panel remains within the carton when the first drawer panel is spaced apart from the first carton panel by a safety length ($L_s$) that is defined as a maximum length of an object that, upon insertion of the object into the carton past the first tab edge of the first carton panel, causes the second drawer panel to be situated within the interior of the carton and juxtaposed with a plane defined by a mouth of the carton that is proximal to the second carton panel.

2. The package system of claim 1, wherein the carton includes a first plurality of panels including the first carton panel, the second carton panel, and the third carton panel, and the first plurality of panels encloses and defines the interior of the carton.

3. The package system of claim 1, wherein the first tab edge is a first row of perforations and the first tab is defined by the first tab edge and a first tab fold-line that bridges spaced apart ends of the first row of perforations.

4. The package system of claim 1, wherein the safety length ($L_s$) is an average length of a middle finger of a child.

5. The package system of claim 1, wherein the drawer is configured to slide into and out of the interior of the carton along an axis parallel to the third carton panel.

6. The package system of claim 1, wherein the first tab is configured to provide evidence of insertion of the object into the carton past the first tab edge of the first carton panel.

7. The package system of claim 1, wherein the second tab edge is demarcated by at least one of a cut-line or a second row of perforations.

8. The package system of claim 1, wherein the second tab is configured to be situated between the third carton panel and the third drawer panel when the third drawer panel is adjacent to the second tab fold-line.

9. The package system of claim 1, wherein a sliding motion of the drawer past the second tab fold-line from a first end of the carton that is proximal to the first carton panel toward a second end of the carton that is distal to the first carton panel is resisted by the second tab.

10. The package system of claim 9, wherein the second tab resists the sliding motion of the drawer by having:

a first orientation that is substantially parallel the second drawer panel when the second drawer panel is adjacent to the second tab fold-line, and a subsequent second orientation that is parallel to and between the third carton panel and the third drawer panel when the third drawer panel is adjacent to the second tab fold-line.

11. The package system of claim 9, wherein the second tab resists the sliding motion of the drawer by resisting an urging of the drawer by the object inserted into the carton past the first tab edge of the first carton panel.

12. The package system of claim 9, wherein the second tab resists the sliding motion of the drawer past the second tab when the drawer is urged toward the mouth of the carton by a gravitational force, a centrifugal force, a shaking force, or any combination of two or more of the gravitational force, the centrifugal force, and the shaking force.

13. The package system of claim 1, further comprising a bulkhead panel, the bulkhead panel spaced apart from and opposing the first carton panel and positioned between the first carton panel and the first drawer panel when the drawer is slidingly engaged with the carton, the bulkhead panel comprising an aperture, defined by interior edges of the bulkhead panel, the aperture substantially aligned with and having substantially a same size as the first tab.

14. The package system of claim 13, wherein the carton is manufactured as a one-piece cut blank and the bulkhead panel is spaced apart from the first carton panel by space reservation panel that is an integral piece of the one-piece cut blank.

15. The package system of claim 13, wherein the bulkhead panel is spaced apart from the first carton panel by a distance that is equal to or greater than a width ($W_{TE}$) of the first tab and the width ($W_{TE}$) of the first tab is measured perpendicularly to a first tab fold-line, between the first tab fold-line and a point on the first tab edge that is distal to the first tab fold-line.

* * * * *